US005802420A

United States Patent [19]

Garr et al.

[11] Patent Number: 5,802,420

[45] Date of Patent: Sep. 1, 1998

[54] METHOD AND APPARATUS FOR PREDICTING AND DISPLAYING TONER USAGE OF A PRINTER

[75] Inventors: Charles Michael Garr; Nathan Karl Klemperer; Patricia Ann Valenti, all of Lexington; Earl Dawson Ward, II, Richmond; James Francis Webb, Lexington; Phillip Byron Wright, Lexington, all of Ky.

[73] Assignee: Lexmark International, Inc., Lexington, Ky.

[21] Appl. No.: 854,606

[22] Filed: May 12, 1997

[51] Int. Cl.[6] ..... G03G 15/08

[52] U.S. Cl. ..... 399/27; 347/7; 347/19; 399/24; 399/29

[58] Field of Search ..... 399/24, 27, 29; 347/7, 19

[56] References Cited

U.S. PATENT DOCUMENTS

| | | | |
|---|---|---|---|
| 3,529,546 | 9/1970 | Kollar | 101/426 |
| 3,600,955 | 8/1971 | Bischoff | 73/518 |
| 4,413,264 | 11/1983 | Cruz-Uribe et al. | 346/1.1 |
| 4,513,314 | 4/1985 | St. John et al. | 358/76 |
| 4,612,553 | 9/1986 | Kohler | 346/1.1 |
| 4,721,978 | 1/1988 | Herley . | |
| 4,734,737 | 3/1988 | Koichi . | |
| 4,772,900 | 9/1988 | Nagoshi | 346/140 R |
| 4,847,659 | 7/1989 | Resch, III . | |
| 4,963,927 | 10/1990 | Ishihara . | |
| 4,969,011 | 11/1990 | Faull et al. . | |
| 4,974,024 | 11/1990 | Bares et al. . | |
| 5,049,898 | 9/1991 | Arthur et al. | 346/1.1 |
| 5,068,806 | 11/1991 | Gatten | 395/113 |
| 5,119,132 | 6/1992 | Butler . | |
| 5,132,711 | 7/1992 | Shinada et al. | 346/140 R |
| 5,155,528 | 10/1992 | Morishige et al. . | |
| 5,160,966 | 11/1992 | Shiina et al. . | |
| 5,162,849 | 11/1992 | Yoshino et al. . | |

(List continued on next page.)

*Primary Examiner*—Matthew S. Smith
*Attorney, Agent, or Firm*—Ronald K. Aust

[57] ABSTRACT

An improved printer is provided that predicts how many pages can be printed before the toner or ink cartridge becomes empty, and also predicts how much time remains before this toner or ink cartridge becomes empty. This prediction is based upon the previous printing history of the printer while using this particular toner cartridge. After measuring the quantity of toner left in the toner cartridge, the printer of the present invention will display the approximate quantity of toner remaining in the cartridge on a screen of a host computer that is connected to the printer, either directly or through a network. The monitor screen of the host computer can also display the predicted number of pages remaining, based on the printer's previous usage history as described above. The toner measuring device provides a "level change" output signal when the remaining toner passes through a predetermined gradation threshold, and depending upon the size of the toner cartridge and upon the time and date at which the level change was detected, the predicted number of pages remaining and the actual amount of toner remaining are more accurately updated upon reaching one of these predetermined gradation thresholds. As each gradation level transition occurs, the printer calculates a new value for the "pages per gradation" variable, and also calculates the number of pages that have been printed since the latest cartridge was installed in the printer, the number of pages printed since the last level or gradation change, and the number of pages or sheets printed between the last two level changes. The printer also can approximate the amount of toner used in printing a particular page of print media to create a Toner Tally for each printed page, which can be used to judge the amount of toner used for one print job and compare that to the amount of toner used for a second print job. The Toner Tally uses a combination hardware/software counter to count the number of "active" pels of each page for a print job.

19 Claims, 11 Drawing Sheets

U.S. PATENT DOCUMENTS 5,202,769 4/1993 Suzuki ..... 358/300
5,204,698 4/1993 LeSueur et al. ..... 346/160
5,216,464 6/1993 Kotani et al. ..... 399/24
5,270,728 12/1993 Lund et al. ..... 346/1.1
5,321,468 6/1994 Nakane et al. .
5,327,196 7/1994 Kato et al. .
5,349,377 9/1994 Gilliland et al. ..... 346/153.1
5,459,556 10/1995 Acquaviva et al. .
5,572,292 11/1996 Chatani et al. ..... 399/25
5,594,529 1/1997 Yamashita et al. ..... 399/24 X
5,636,032 6/1997 Springett ..... 347/7 X
5,655,174 8/1997 Hirst ..... 399/27

METHOD AND APPARATUS FOR PREDICTING AND DISPLAYING TONER USAGE OF A PRINTER

TECHNICAL FIELD

The present invention relates generally to printing equipment and is particularly directed to a printer of the type which provides information as to toner usage. The invention is specifically disclosed as a printer that is connected to a host computer in which a user at the host computer may interrogate the printer to see how much toner remains in the printer, and also to see a prediction as to how many pages can be printed or how many days of printing are yet available from the existing toner cartridge.

BACKGROUND OF THE INVENTION

Electrophotographic printers have been available for years which use a charged photoconductive member at various voltage levels to either attract or repel a special ink known as "toner." Once the toner has been attracted to particular areas of the photoconductive member (typically a rotatable photoconductive drum), the drum or member is rotated to a point where it can come into contact with a sheet of print media, such as paper. At this time, the toner is deposited upon the paper, and then typically is made to firmly adhere to the print media by a fuser.

Of course, the toner level in such a printer is critical, and users appreciate knowing how much toner is available in a printing device. This is particularly true in the case of a "remote" printer in which the user is working at a host computer that is connected via some type of network to the remote printer. In this situation, the user cannot see the remote printer, and may in fact be located several hundred feet from that printer. If the user transmits a large print job via the network to this remote printer, the user may be distressed when finding out that the printer ran out of ink or toner in the middle of this large print job. The main reason for this distress is that the user was not able to determine, while sitting at the host computer, that the toner level was about to expire at the printer, and the user did not find this out until walking the several hundred feet to the printer. If the user was able to determine in advance that the toner level was relatively low, the user could take some steps to either more accurately estimate the possibilities of printing the entire print job using the amount of toner remaining in the currently installed toner cartridge at the printer, or could first go to the printer and install a new cartridge or ask someone at the network administrative level to replace the toner cartridge.

To predict how many pages will be able to be printed on the remaining amount of toner in a cartridge is not necessarily an easy task. Many printer manufacturers estimate that, at least for text-type documents (such as word processing documents), the percent coverage of toner on a printed page will be around 5%, and base their number of pages that can be printed on this 5% statistic for an 8½×11 inch page. Of course, the 5% estimate is not entirely accurate, and in actual usage, this percentage could vary either greater or less than 5% depending upon the type of documents actually being printed at a particular printer. For example, documents used in creating black-line drawings may have quite a large amount of blank spacing, and may use even less toner than a text document from a word processor. Of course, the thickness of the drawing lines and the amount of detail on a particular drawing would be a determinative factor in this estimate. On the other hand, an accounting document, such as a spreadsheet or ledger document, may be printed on a large piece of paper, such as a page that is 8½×14 inches in size. Even if the toner usage is actually at 5% in the legal-size document, the true amount of toner for a single printed page would be greater than the 5% estimate for a typical 8½×11 inch document.

Users that create graphic artwork or computer-generated images will very likely find that the 5% estimate will be much too low for their type of documents. This is particularly true for any type of photograph or other image that uses continuous tones (also known as "contones").

Previous inventions have been disclosed to at least determine the amount of toner that is being applied to certain documents. For example, U.S. Pat. No. 5,204,699 discloses a printer that measures the mass of toner used to print a sheet of print media by summing the individual toner mass signals, which are a function of the image intensity signals. U.S. Pat. No. 5,349,377, estimates the consumption of toner for a digital copy machine, by analyzing the frequency rate of 1's and 0's for the pixels, and calculating weighting factors for different types of images. This pixel frequency can be tracked per page, and additional weighting factors could be related to the developer system voltage bias level, which typically is set by operator controls for a lighter or darker copy.

U.S. Pat. No. 5,459,556 discloses a printer or copier that also can measure the toner usage per print. The operator's actuable settings can affect the toner usage, and this is taken into account. These operator actuable settings include the contrast and the lighter/darker controls. Based on these settings, the toner consumption rate can be estimated more accurately to calculate the number of remaining copies that could be made from the existing toner cartridge. This toner consumption rate is based, however, on the original estimated percent usage rate, with modifications for the user actuable settings, and not on a measurement of actual toner usage.

The existing conventional printers and copiers may have the capability of measuring the amount of toner being used per page, and may also be able to estimate how many pages can yet be printed from the remaining toner in an existing cartridge, however, these characteristics are related to the original estimate of a certain percentage of toner used per document printed. This is not the same as attempting to predict the future number of copies that can be printed from the existing toner cartridge based on an actual previous printing history. The conventional printers and copiers also do not disclose the capability of updating their remaining usage predictions based upon actual toner level changes within the toner cartridge itself.

SUMMARY OF THE INVENTION

Accordingly, it is a primary object of the present invention to provide a printer that can measure an actual toner or ink level within the printer's toner cartridge, or inkjet cartridge, to predict the number of pages that can still be printed using that cartridge, or to predict the amount of time that will pass before the cartridge becomes empty, based upon the previous actual printing history.

It is another object of the present invention to provide a printer that keeps track of the amount of toner remaining in the toner cartridge of the printer in predetermined graduations (or "gradations"), and refines its prediction as to the number of pages remaining to be printed before the toner cartridge becomes empty based upon the most recent history of toner usage versus the number of pages actually printed.

It is a further object of the present invention to provide a printer that predicts how many pages can be printed using the remaining toner in the toner cartridge, or can predict how much time will elapse before the toner cartridge becomes empty, in which a scaling factor is used for each page being printed that depends on the print resolution of the pels being applied to the print media.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved printer is provided that predicts how many pages can be printed before the toner or ink cartridge becomes empty, and also predicts how much time remains before this toner or ink cartridge becomes empty. This prediction is based upon the previous printing history of the printer while using this particular toner cartridge. This previous history can also be maintained back to an earlier toner cartridge that was previously installed in the printer, to more accurately predict the initial usage rate of a new toner cartridge that is installed in the printer.

Using a preferred apparatus to measure the amount of toner left in the toner cartridge, the printer of the present invention will display the approximate quantity of toner remaining in the cartridge on a screen of a host computer that is connected to the printer, either directly or through a network. The monitor screen of the host computer can also display the predicted number of pages remaining, based on the printer's previous usage history as described above. The toner measuring device preferably provides a "level change" output signal when the remaining toner passes through a predetermined gradation threshold, and depending upon the size of the toner cartridge and upon the time and date at which the level change was detected, the predicted number of pages remaining and the actual amount of toner remaining are more accurately updated upon reaching one of these predetermined gradation thresholds. As each gradation level transition occurs, the printer calculates a new value for the "pages per gradation" variable, and also calculates the number of pages that have been printed since the last cartridge was installed in the printer, the number of pages printed since the last level or gradation change, and the number of pages or sheets printed between the last two (2) level changes.

The printer of the present invention also has the capability of approximating with good accuracy the amount of toner used in printing a particular type of page of print media. The printer of the present invention also takes into account the resolution (in dots per inch) being used to print a particular page, as this affects the amount of toner used to print a particular pel or slice of a pel.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
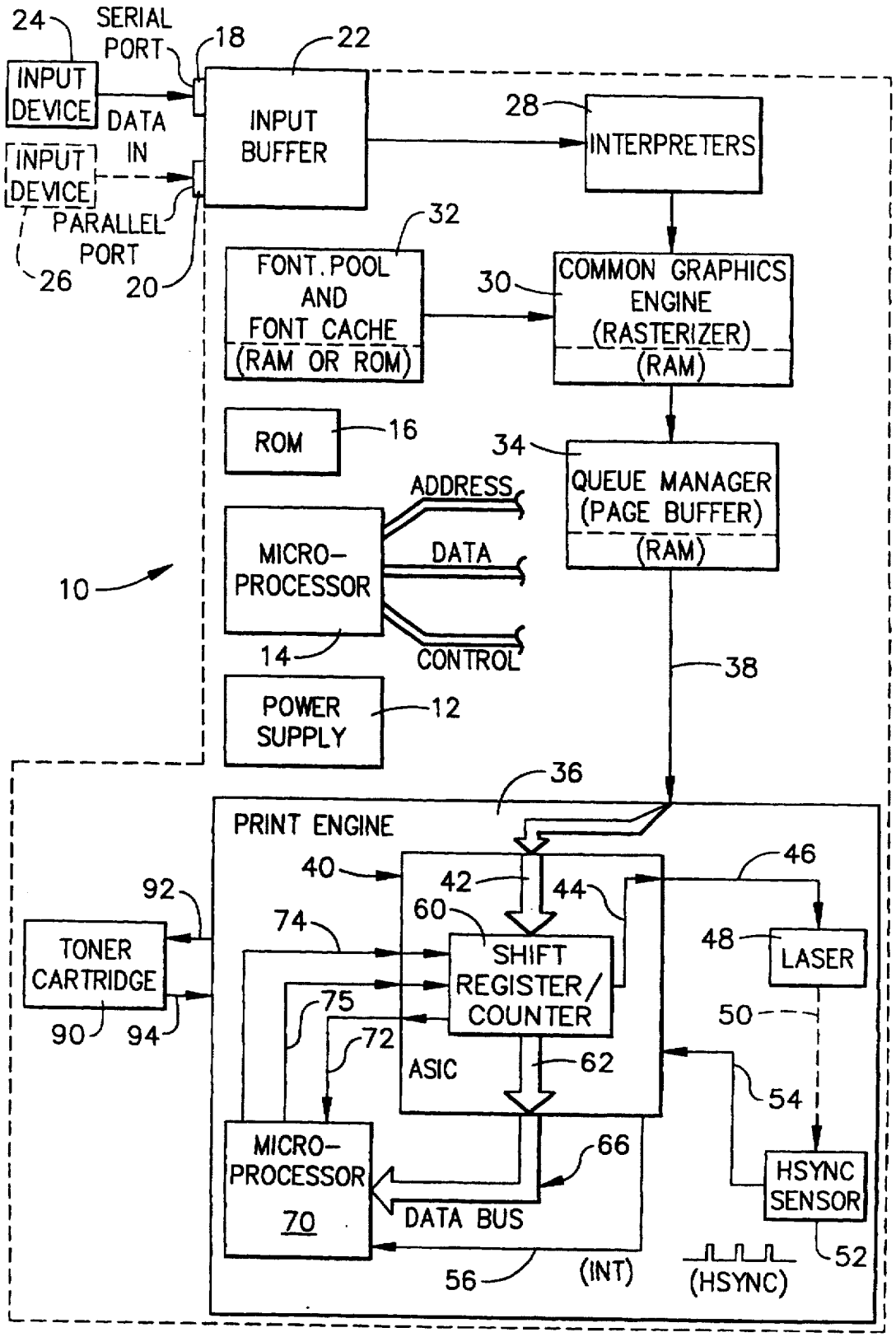
FIG. 1 is a hardware block diagram of the major components used in a laser printer, as constructed according to the principles of the present invention.

Referring now to the drawings, FIG. 1 shows a hardware block diagram of a laser printer generally designated by the reference numeral 10. Laser printer 10 will preferably contain certain relatively standard components, such as a DC power supply 12 which may have multiple outputs of different voltage levels, a microprocessor 14 having address lines, data lines, and control and/or interrupt lines, Read Only Memory (ROM) 16, and Random Access Memory (RAM), which is divided into several portions for performing several different functions.

Laser printer 10 will typically also contain at least one serial input or parallel input port, or in many cases both types of input ports (as well as other types of ports in some printers), as designated by the reference numeral 18 for the serial port and the reference numeral 20 for the parallel port. Each of these ports 18 and 20 would be connected to a corresponding input buffer, generally designated by the reference numeral 22 on FIG. 1. Serial port 18 would typically be connected to a serial output port of a personal computer or a workstation that would contain a software program such as a word processor or a graphics package or computer aided drawing package. Similarly, parallel port 20 could also be connected to a parallel output port of the same type of personal computer or workstation containing the same type of programs, except that the data cable would have several parallel lines, instead of only a pair of wires that makes up many serial cables. Such input devices are designated, respectively, by the reference numerals 24 and 26 on FIG. 1.

Once the text or graphical data has been received by input buffer 22, it is commonly communicated to one or more interpreters designated by the reference numeral 28. A common interpreter is PostScript™, which is an industry standard used by most laser printers. After being interpreted, the input data is typically sent to a common graphics engine to be rasterized, which typically occurs in a portion of RAM designated by the reference numeral 30 on FIG. 1. To speed up the process of rasterization, a font pool and possibly also a font cache is stored, respectively, in ROM or RAM within most laser printers, and these font memories are designated by the reference numeral 32 on FIG. 1. Such font pools and caches supply bitmap patterns for common alphanumeric characters so that the common graphics engine 30 can easily translate each such character into a bitmap using a minimal elapsed time.

Once the data has been rasterized, it is directed into a queue manager or page buffer, which is a portion of RAM designated by the reference numeral 34. In a typical laser printer, an entire page of rasterized data is stored in the queue manager during the time interval that it takes to physically print the hard copy for that page. The data within the queue manager 34 is communicated via a data bus 38 in real time to a print engine designated by the reference numeral 36. Print engine 36 includes a laser light source within the printhead, and its output is the physical inking onto a piece of paper, which is the final print output from laser printer 10.

It will be understood that the address, data, and control lines are typically grouped in buses, and which are physically communicated in parallel (sometimes also multiplexed) electrically conductive pathways around the various electronic components within laser printer 10. For example, the address and data buses are typically sent to all ROM and RAM integrated circuits, and the control lines or interrupt lines are typically directed to all input or output integrated circuits that act as buffers.

Print engine 36 contains an ASIC (Application Specific Integrated Circuit) 40, which acts as a controller and data manipulating device for the various hardware components within the print engine. The bitmap print data arriving from Queue Manager 34 is received by ASIC 40, and at the proper moments is sent via a bus of data lines 46 to the laser light source, which is designated by the reference numeral 48.

ASIC 40 controls the various motor drives within the print engine 36, and also receives status signals from the various hardware components of the print engine. Another important signal received by ASIC 40 is known as the "HSYNC" signal, which is received from an optical sensor designated by the index number 52 and called the HSYNC sensor. The laser light source 48 generates a moving beam of light that sweeps or "scans" across a "writing line" on a photoconductive drum (not shown), thereby creating a raster line of either black or white print elements (also known as "pels"). As the laser light scans to create this raster line, the laser light momentarily sweeps across HSYNC sensor 52 at the beginning of each sweep or scan. The laser light travels from laser 48 to the HSYNC sensor 52 along a light path, designated diagrammatically by the reference numeral 50 on FIG. 1. This produces an electrical pulse output signal from HSYNC sensor 52, which is communicated to ASIC 40 by a signal line 54.

HSYNC signal 54 could be immediately directed to a microprocessor 70 in the print engine, however, it is preferred to use a "divide-by-n" counter (not shown) within ASIC 40, to reduce the frequency of pulses leaving ASIC 40 along a control line 56, before arriving at microprocessor 70. It is preferred in the divide-by-n counter to set the value for "n" to eight (8), thereby dividing HSYNC sensor output signal frequency by eight (8) before that signal is translated into an interrupt signal on control line 56, which will be used to interrupt the microprocessor's operations at a much less frequent time interval.

As the print data in bitmap form arrives at print engine 36, it is transferred to ASIC 40 via a parallel data bus, and once inside ASIC 40, is further communicated by a set of parallel data lines 42 to a shift register/counter circuit designated by the reference numeral 60. The details of shift register/counter 60 are provided in FIG. 2.

One output from shift register/counter 60 is a serial data signal line 44 that transmits the print data to the laser light source 48. Other outputs from shift register/counter 60 include the most significant bit (MSB) of the counter at a data line 72, and the actual count value from the counter at a series of parallel data lines 62. Another input to shift register/counter 60 is a "clear MSB" signal 74 from the microprocessor 70. Still another is a "clear count" signal 75.

Figure 2:
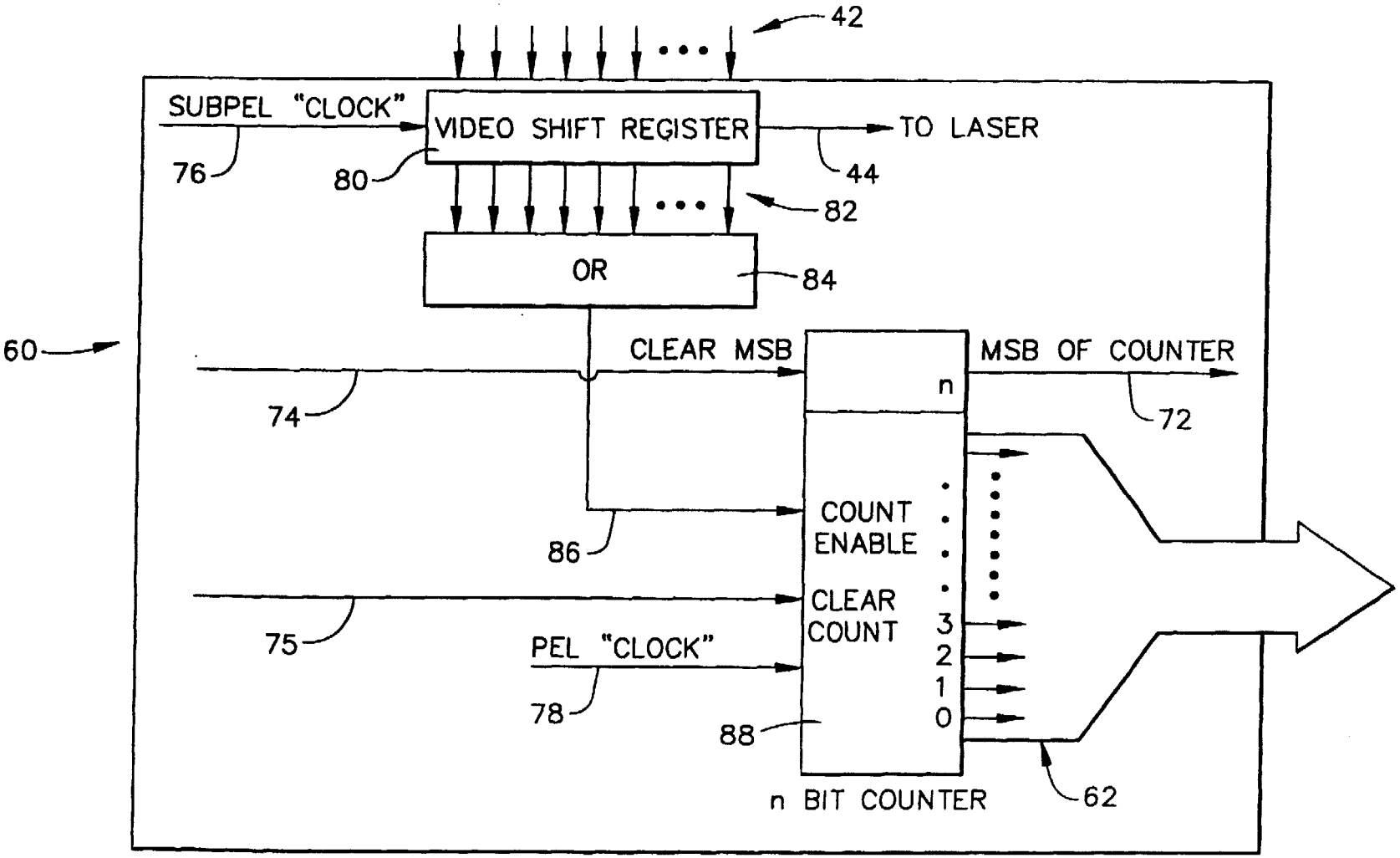
FIG. 2 is a hardware block diagram in partial schematic of a portion of the ASIC device used in the print engine of the laser printer of FIG. 1.

The parallel data lines 42 into ASIC 40 bring bitmap print data to a video shift register, designated by the reference numeral 80 (see FIG. 2). It is preferred that the parallel data lines 42 be at least eight (8) lines wide, so that this "bus" can hold at least one entire data byte of bitmap print data. Video shift register 80 is driven by a "subpel clock" designated by the reference numeral 76. The bitmap data is passed to edge enhancing logic which generates a slice map of data which is used to control the laser for each pel of the bitmap. In the preferred mode of operation, each pel of bitmap print data is divided into at least eight (8) "slices" so that the darkness or "gray" level of each pel can be at values other than a pure white pel (having a value of Logic 0) or total black (having a value of Logic 1 for all slices). If there are eight slices per pel, then it would be sufficient for there to be only eight (8) data lines in the data bus 42.

Assuming that there are eight slices per pel, then the subpel clock frequency at the line 76 would be a frequency eight (8) times greater than the data rate frequency needed to print a single pel of print data. Upon each subpel clock transition, the parallel bitmap print data for a single pel will be translated into a serial data format, and this serial data will be clocked out of video chip register 80 at the subpel clock 76 frequency rate, along data line 44 to the laser 48.

Video shift register 80 also produces a parallel output at data lines 82 on FIG. 2, and these parallel data lines are directed to a multiple input OR-gate, designated by the reference numeral 84. The parallel outputs on lines 84 are latched for a sufficient time interval until the entire pel has been processed through the video shift register 80. If the entire pel currently being transferred through video shift register 80 has zero or "blank" data, then the output of OR-gate 84 will be at Logic 0 on data line 86. On the other hand, if one or more of the slices for the current pel being transferred through video shift register 80 is set to Logic 1, then the output of OR-gate 84 will currently be at Logic 1.

This output line 86 from OR-gate 84 is directed to an n-bit counter, designated by the reference numeral 88, as the "count enable" input. Another input to n-bit counter 88 is a "pel clock" 78, which runs at a frequency equal to the time period necessary to print an entire pel via the laser 48. After the entire group of slices for the current pel are transferred through video shift register 80, the pel clock 78 will make a transition so that the count enable input will either cause n-bit counter 88 to increment, or to remain at its present count value. This depends upon the logic state at the count enable input, due to the logic signal on data line 86. If at least one of the slices of the current pel had a Logic 1 state, then the count value will be incremented at the outputs of n-bit counter 88, and these outputs are communicated to a parallel set of data lines designated by the reference numeral 62.

In the preferred embodiment, the n-bit counter 88 is set up to have twenty (20) parallel output bits, which is large enough to count a sufficient number of pels so that in two (2) software sampling periods the counter will not overflow. Before a page is printed, the entire counter 88 is cleared by microprocessor 70 by pulsing at the "clear count" signal 75, and microprocessor 70 clears an internal counter. While a page is being printed, the system operating software will sample the most significant bit (MSB) at signal line 72 of n-bit counter 88. If this MSB data line 72 is set to Logic 1, the operating software at the microprocessor 70 will detect this signal and send out a "Clear MSB" signal along the data line 74. In addition, the internal counter in microprocessor 70 will be incremented, while the Clear MSB signal 74 is input to n-bit counter 88, which then resets the value of its most significant bit output to Logic 0.

If the MSB of the n-bit counter 88 at line 72 remains at Logic 0, then microprocessor 70 does not send a Clear MSB signal along data line 74. Regardless as to the status of the data lines 72 and 74, all of the other output bits in the n-bit counter 88 are left unchanged. If the Clear MSB signal at data line 74 is activated to Logic 1, then the count value at the output of n-bit counter 88 is reduced by the value of $2^n$. Once the end of the printed page is reached, the operating software handles the MSB as usual, multiplies its accumulated count by $2^n$, and adds the value at the output bits 62 to produce a value which represents the total number of pels on this page which had at least one active slice.

Using this scheme, it is important that the counter 88 not be allowed to wrap around more than once before the microprocessor 70 has a chance to accumulate the count and reset the MSB (i.e., output bit 72) to prevent a counter overflow a second time. The preferred 20-bit counter 88 provides sufficient counting capacity for an eleven-inch writing line at 1200 dots per inch (dpi). It will be thus seen that the counter for the present invention is implemented by hardware in part and by software in part, in which the most significant output bit from counter 88 is repeatedly reset by microprocessor 70, as needed, while the lesser significant output bits act solely as a hardware counter, and this scheme thereby reduces the cost for an otherwise much larger hardware counter. It will be understood that other methods to manipulate various hardware counter inputs and outputs can be controlled by microprocessor 70 without departing from the principles of the present invention.

On FIG. 1, the reference numeral 66 refers to a data bus within print engine 36 that interfaces between microprocessor 70 and ASIC 40, and which carries the count information from counter 88 at the proper moments. Also on FIG. 1 is a toner cartridge designated by the reference numeral 90, which represents a generic cartridge that holds ink or toner for any type of ink jet or laser printer, respectively. A signal line 92 is used to request an updated toner level value, which will then be transferred by a signal line 94 to print engine 36. A toner level detecting device, disclosed in U.S. patent application Ser. No. 08/602,648, now issued as U.S. Pat. No. 5,634,169, has been successfully demonstrated in conjunction with the present invention. As used herein and in the claims, the term "toner" represents a type of inking material that forms black or colored dots on a print media, and includes liquid ink, dry ink, thermal wax, dye sublimation material, and the like.

The circuit depicted in FIG. 2 will "track" the functions of a printing device having a serial output signal that controls the on-off signaling of slices within a pel. This hardware circuit counts any pel having a non-zero laser modulation as an "on-pel." The print engine control software accumulates this information and applies a print resolution scaling factor to the data, and this information is then made available to a host computer. The proper use of this information can increase the accuracy of the per page toner usage and the toner cartridge empty prediction.

In the illustrated embodiment, the printing system tracks the toner usage on a per page basis, which allows for the classification of the "coverage" of the users' print jobs in order to perform more accurate life-cost estimates. In previous conventional systems, users could only base their estimates on a 5% coverage statistic which a printer manufacturer would advertise. The present invention also allows the users of the printer to relate their toner usage not only to paper usage, but also to the resolution that is associated with a particular page being printed.

The preferred ASIC 40 has the ability to count any pel that has any amount of Logic 1 "black" data contained therein, and the ability to accumulate the total number of "on-pels" for a given printed page. This information can be sent to the host computer for capture into a statistics data file, which then gives the system administrator the ability to track toner usage of this printer in the form of a number that allows relative usage comparisons from user to user on a given printer using a given print toner cartridge. As the print engine accumulates the "on-pel" count at the end of each page, also designated as the "Toner Tally," the raw Toner Tally data is sent to the RIP (i.e., the Raster Image Processing system of the printer) for further processing. This toner tally information is represented by a four byte value, with each increment representing one pel at the given resolution. The RIP is also informed of the resolution for this particular printed page, and will scale the raw toner tally by a resolution scaler as a whole number multiplier. Once scaled, the resultant thirty-two bit number is divided by 12288, so that when this count is accumulated for a job, it will not overflow out of thirty-two (32) bits. In addition, this scale factor will represent a standard metric of measurement, and in particular at 1200 dpi, there are 122,880,000 pels on a letter size page. By dividing this four-byte variable by the number 12,288, the resultant incremental numeric quantity will be equivalent to 0.01% coverage for a letter sized page (in a normal Print Area Mode).

Figure 3:
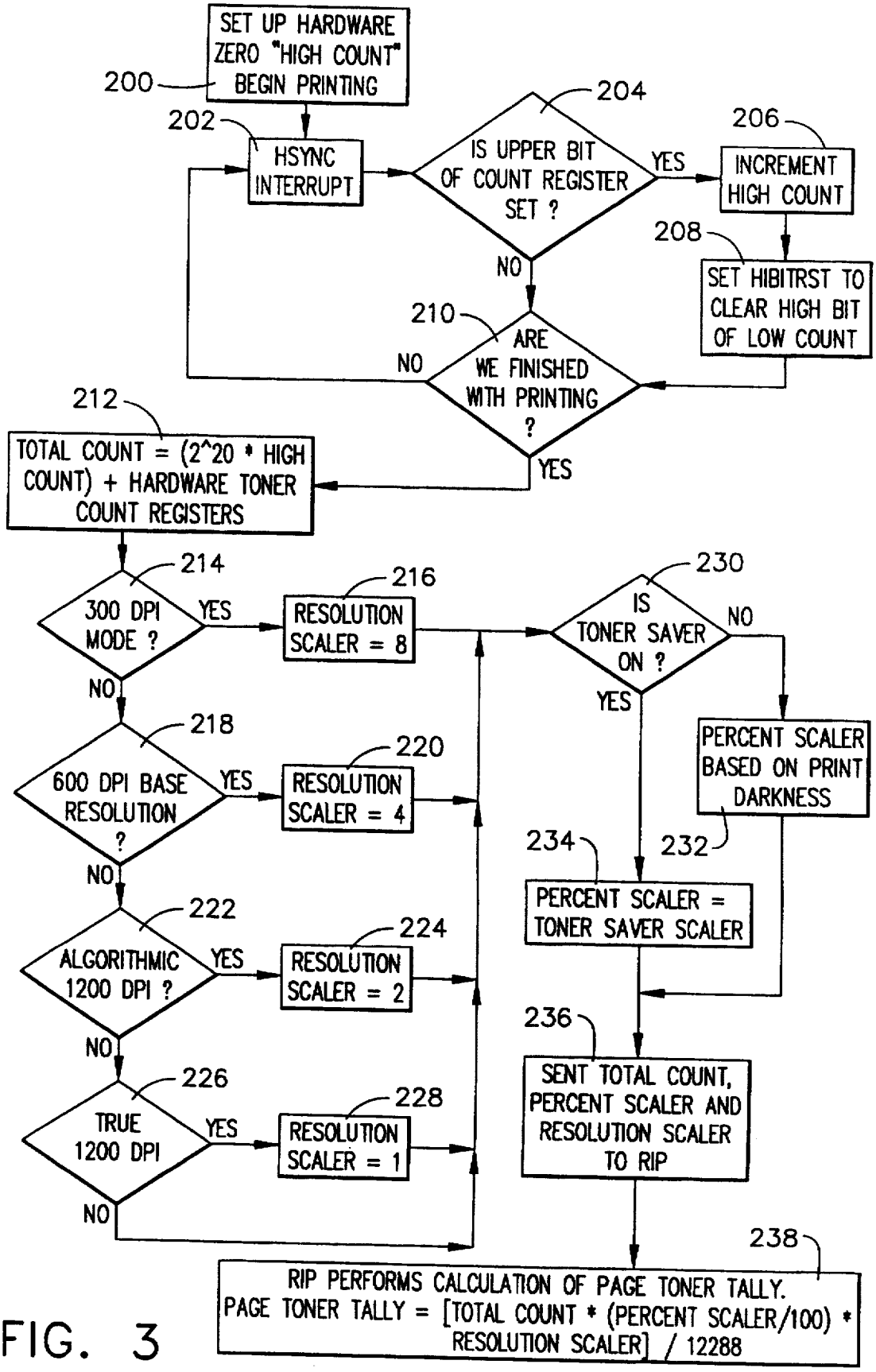
FIG. 3 is a flow chart depicting the logical steps taken to determine a "page toner tally" of a particular print job that is being printed by the laser printer of FIG. 1.

After the RIP accumulates the page tallies during the printing of a print job, the resultant thirty-two (32) bit cumulative value is sent to the host computer that is running MARKVISION® at the end of the print job. These calculations are performed using the logical operations depicted in the flow chart of FIG. 3. Starting at a function block 200, the hardware is initialized, the "High Count" is set to zero, and the print job begins printing. The variable "High Count" is stored in a byte of the printer's RAM that interfaces with microprocessor 70 of print engine 36.

Next, a function block 202 waits for an interrupt based on the HSYNC signal at signal line 54, and the logical flow is directed to a decision block 204. At decision block 204, the upper bit of the counter 88 (i.e., its output signal 72) is inspected to see if it is set to Logic 1. If the answer is YES, the logic flow is directed to a function block 206 which increments the "High Count." After that has occurred, a function block 208 sets a variable "HIBITRST" to clear the high bit is of the "low count," via input signal 74.

If the result at decision block 204 was NO, the logic flow is directed to a decision block 210, which determines whether or not the system is finished printing this particular page. If the answer is NO, the logic flow is directed back to function block 202 and waits for the next HSYNC interrupt to occur. If the answer is YES, the logic flow is directed to a function block 212.

At function block 212, a variable named "Total Count" is calculated, and is based on both the "high count" and the count value of the hardware counter 88. If the high bit of the "TNRCNT" variable within ASIC 40 has been set to Logic 1, then the system software increments the count value in the RAM at function block 206, and zeroes the high bit of this count at function block 208. At function block 212, the value of the "High Count" is multiplied by $2^{20}$. This value is added to the value of the hardware count registers of counter 88, and this provides a "raw" toner tally based on 1200 dpi resolution.

The logic flow is now directed to a series of decision blocks which determines what resolution was used for this particular printed page. If the resolution was 300 dpi, then decision block 214 directs the logic flow to a function block 216 that sets the resolution scale factor to eight (8). If the resolution for this page was 600 dpi, then decision block 218 directs the logic flow to a function block 220 that sets the resolution scale factor to four (4). If the resolution for this page was "algorithmic 1200 dpi," then a decision block 222 will direct the logic flow to a function block 224, which sets the resolution scale factor two (2). Finally, if the resolution was a true 1200 dpi, then a decision block 226 will direct the logic flow to a function block 228 which sets the resolution scale factor to one (1). If the resolution was none of the above, then the logic flow is directed out the NO output from decision block 226, and the resolution scaler will default to the value one (1).

The logic flow is now directed to a decision block 230 which tests to see if the "Toner Saver" function has been turned on. If the answer is NO, the logic flow is directed to a function block 232 which determines that the percent scaler for toner usage is to be based upon the "print darkness" variable. It is preferred that the print darkness scaler be set to 100% if the print darkness has been set to "normal." On the other hand, if the print darkness value is set to "darkest" the scale factor is preferably set to 119%, if set to "dark" the scale factor is preferably 106%, if set to "light" the scale factor is preferably set to 94%, and if set to "lightest" the scale factor is preferably set to 79%.

If the "Toner Saver" feature is turned on, the logic flow follows from decision block 230 to a function block 234 that sets the percent scaler to a known "Toner Saver Scaler" value. It is preferred that the scale factor be set to 61% if the Toner Saver function has been turned on.

The logic flow now is directed to a function block 236 that sends the total count, percent scaler, and resolution scaler to the RIP image processing portion of the printer. After that has occurred, the RIP performs the page toner tally calculation at a function block 238. This page toner tally is equal to the equation:

$$\{[\textit{Total Count} * (\textit{\% Scaler}/100) * \textit{Resolution Scaler}]/12{,}228\}.$$

It will be understood that the resolution scale factors at function blocks 216, 220, 224, and 228, are related to the actual resolution of a particular printer that is using the present Toner Tally invention. At function block 216, the typical resolution scale factor would be sixteen (16) for a pure 300 dpi mode; however, in the preferred mode of the present invention, the ASIC actually converts 300 dpi into a 300×600 resolution, and the scale factor therefore is only eight (8). At function block 224, the resolution scale factor is equal to two (2) because the "algorithmic" 1200 dpi mode is actually a resolution of 600×1200. It can be seen that any resolution can be used with the present invention, and the scale factor would be adjusted accordingly. The same is true with various values for print darkness scaling factors.

The "Toner Saver" feature preferably uses a combination of dithering of internal black areas and a duty cycle reduction on non-internal black pels to reduce the amount of toner used in a print job. The numeric value for the toner tally that comes out of the low level calculation and, with the addition of the resolution scaling and Print Darkness adjustments, needs to be further adjusted to take into effect the toner savings. The type of page printed would have an impact on the true amount of toner savings at the cartridge level, however, generally speaking it is sufficiently accurate to use a percent reduction of the total count across the board for all types of printing applications without incurring significant error.

It will be understood that a more precise calculation of toner usage could be had by merely summing the exact amount of slices being printed instead of counting the number of pels that have at least one non-zero slice in each pel. To perform this calculation, with reference to FIG. 2, the serial output on signal line 44 to the laser could additionally be communicated to the input of an n-bit counter, such as counter 88. This would eliminate both the OR-gate 84 and the parallel signal lines 82. Of course, it will be understood that the n-bit counter would have to be several bits larger in size to hold all of the data, since the number of slices being printed on a particular page will be greater than the number of pels being printed for that same page. One other change in the diagram of FIG. 2 to implement this more accurate Toner Tally circuit would be that the "subpel clock" 76 would also be directed to the clock input for the n-bit counter, rather than the pel clock signal 78 shown on FIG. 2, however, the high speed of this signal may be taxing on all but the smallest die size ASIC.

In another aspect of the invention, the amount of toner (or the ink level) within the cartridge is measured and, based on previous printing history for this cartridge, the number of pages that still can be printed using that cartridge or the amount of time that will pass before the cartridge is empty is calculated and displayed at a host computer. At the print engine level, once power has been established (i.e., upon a Power-on Reset), the print engine queries the RIP for the last toner level detected. The printer will then determine whether or not to send the toner level to the host computer, or to send an "unknown" data value to the RIP. This "unknown" state will not cause the RIP to store any new information, but will flag the condition that the print engine currently is not sure of the level, and the host will handle this condition appropriately.

The printer must also read the cartridge configuration, which includes the capacity or size of the toner cartridge. Once the cartridge has been inspected, the print engine will inform the RIP how many levels or "gradations" that can be reported concerning this particular cartridge. This information is stored in EEPROM by the RIP.

Figure 4A:
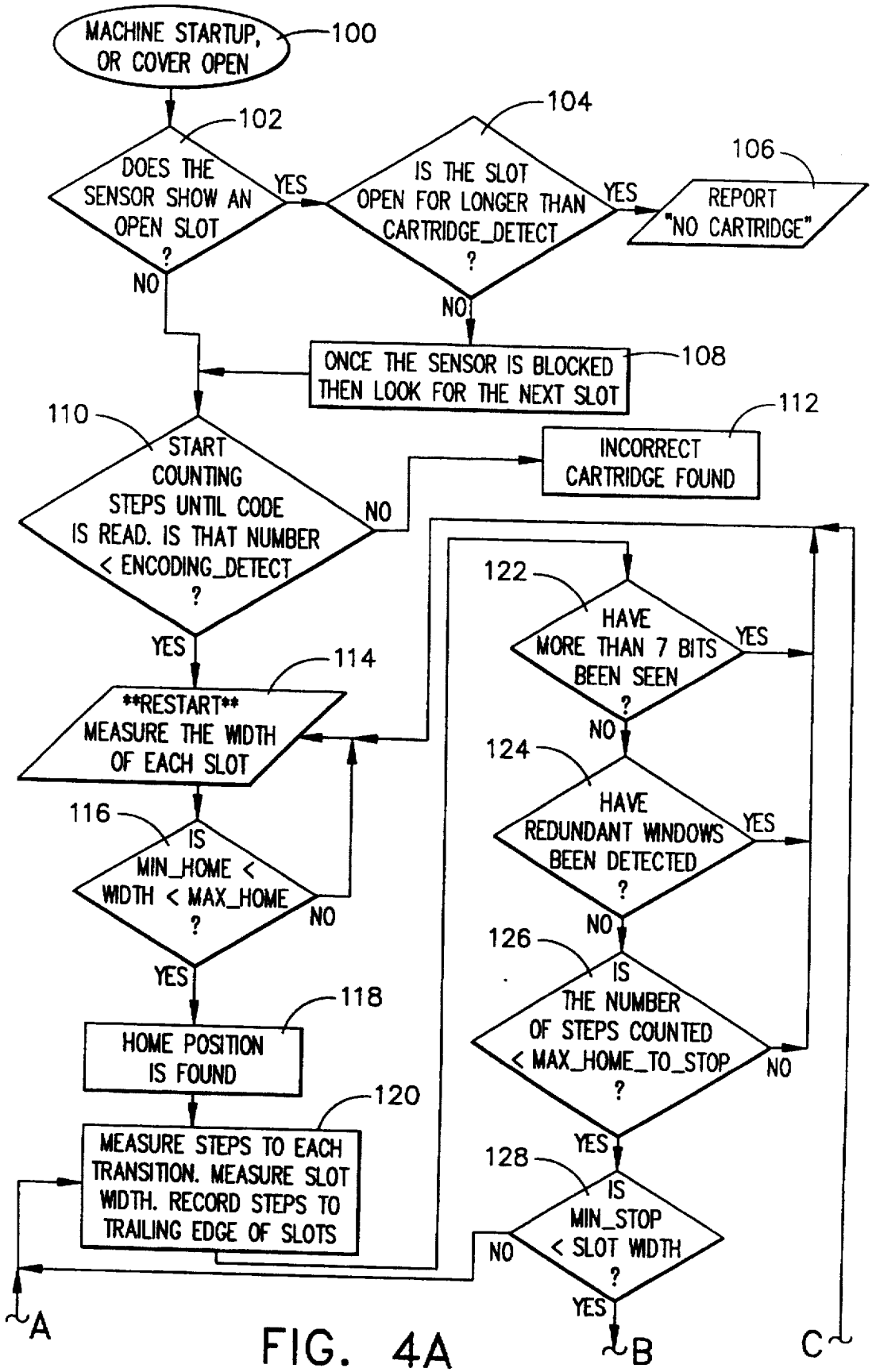
FIGS. 4A and 4B represent a flow chart depicting the logical steps taken to determine the type of print cartridge that has been installed in the laser printer of FIG. 1.
Figure 4B:
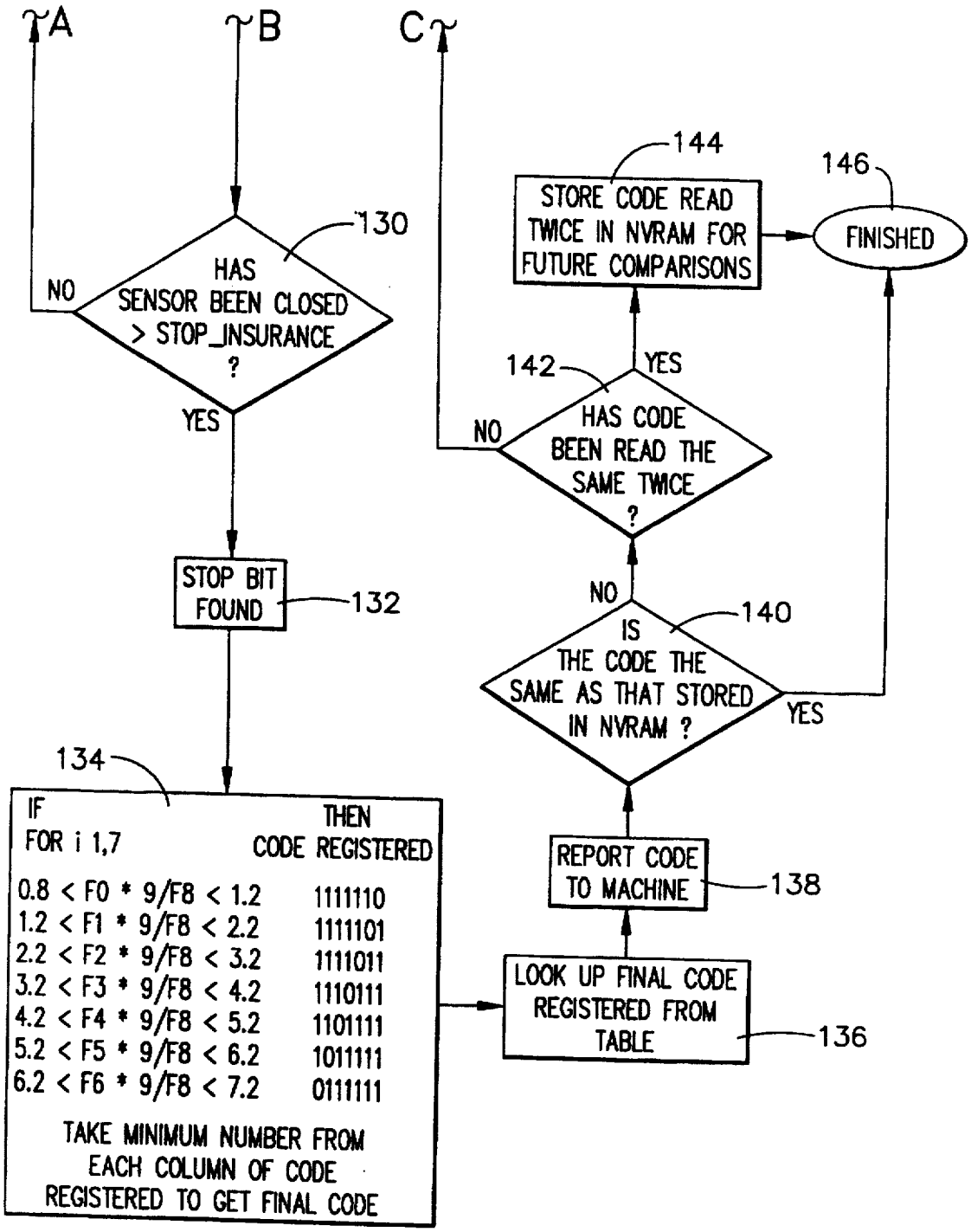

The flow chart of FIGS. 4A and 4B shows the logical steps to inspect the toner cartridge. Starting at a function block 100, the printer has just either started up, or the cover was recently opened. The logic flow travels to a decision block 102 which determines if the cartridge detecting sensor shows an open slot (not shown). If the answer is YES, a decision block 104 determines whether or not the slot has been opened for longer than a time interval that is set by a variable named "CARTRIDGE_DETECT." If the answer at decision block 104 is YES, then a function block 106 reports to the RIP that there is "NO CARTRIDGE" installed in the printer at this time. If the answer at decision block 104 was NO, then a function block 108 looks for the next slot once the sensor is blocked.

If the answer at decision block 102 was NO, then the logic flow is directed to a decision block 110 that starts counting steps until the cartridge's code is read. The numeric value of this code is compared to a variable named "ENCODING_DETECT", and if the code is not less than or equal to the variable ENCODING_DETECT, then a function block 112 will determine that an incorrect toner cartridge was found. On the other hand, if the numeric code is less than or equal to the variable ENCODING_DETECT, then a function block 114 will measure the width of each slot.

Function block 114 begins a subroutine, or a series of functions, that will end with a determination that a correct toner cartridge has been installed in the printer, and the cartridge's code will be then stored in non-volatile memory. Starting at a decision block 116, the width is inspected to see if it falls within the boundaries of two thresholds, between the value "MIN_HOME" and "MAX_HOME." If the answer is NO, the logic flow is directed back to function block 114 to measure the next slot width. If the answer is YES, the logic flow is directed to a function block 118, which means that the "home position" has been found.

The next step is at a function block 120 in which the steps to each transition are measured, the slot is measured, and the steps to the trailing edge of the slots are recorded. At a function block 122, it is determined if more than seven (7) bits have been detected, which corresponds to the number of optically-important slots in the wheel of the preferred toner measuring device. If the answer is YES, the logic flow is directed back to function block 114. If the answer is NO, the logic flow is directed to another decision block 124 that determines whether or not redundant windows have been detected. If the answer is YES, the logic flow is directed back to function block 114. If the answer is NO, the logic flow is directed flow is directed to a decision block 126.

At decision block 126 it is determined if the number of steps that have been counted are less than a predetermined variable value having the variable name "MAX_HOME_TO_STOP." If the answer is NO, the logic flow is directed back to function block 114. If the answer is YES, the logic flow is directed to a decision block 128 that determines if the variable "MIN_STOP" is less than the slot width. If the answer is NO, the logic flow is directed back to function block 120. If the answer is YES, the logic flow is directed to a letter "B" that directs the logic flow to FIG. 4B.

On FIG. 4B, the logic flow from letter "B" is directed to a decision block 130 that determines whether or not the sensor has been closed (i.e., because no window was detected). If the stop bit has been detected, the logic flow travels to a function block 132. If not, the logic flow travels to a letter "A" which directs the logic flow back to function block 120 on FIG. 4A.

From function block 132, the logic flow is directed to a function block 134, which generates a final code from the previous code registrations. The logic flow now travels to a function block 136 that looks up the final code registered from a table. At a function block 138, this code is then reported to the RIP of the printer.

The logic flow is now directed to a decision block 140, which determines whether or not the code is the same that was previously stored in non-volatile memory, preferably a non-volatile random access memory or NVRAM. If the answer is YES, the logic flow travels to a function block 146 that finishes this subroutine. If the answer is NO, the logic flow is directed to another decision block 142 that determines whether or not this same code has previously been read once before. If the answer is YES, function block 144 stores in NVRAM for future comparisons the code that has been read twice, and the logic flow is directed to the "finished" function block 146. If the answer is NO at decision block 142, then the logic flow is directed to a letter "C" which directs the logic flow back to function block 114 on FIG. 4A. The print engine also performs the operational steps to determine the toner gradation level during the process of printing a page. During one of the determinations, if the resultant level differs by more than two gradations from the previous level detected, the print engine informs the RIP of the new level. It also reports a four-byte "Toner Tally" for each page printed and a scaling factor to the RIP, and the RIP can perform the final Toner Tally calculation using its 32-bit math capabilities.

Figure 5:
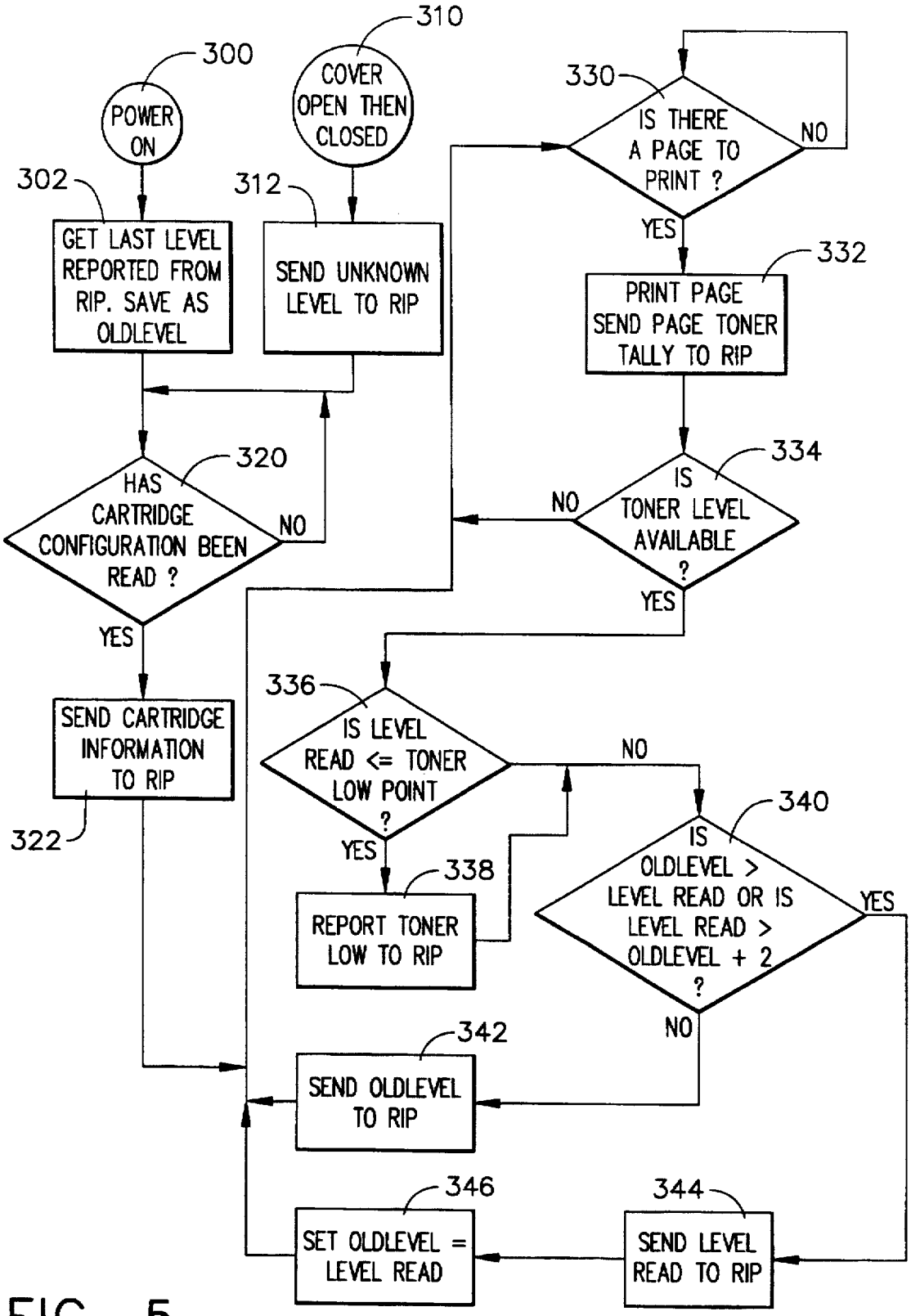
FIG. 5 is a flow chart depicting the logical steps taken to determine which toner level is to be reported by the print engine to the imaging system of the laser printer of FIG. 1.

FIG. 5 is a flow chart showing the operational steps that the print engine undergoes to determine the toner level to be reported to the RIP. Starting at a "power on" function block 300, and at a function block 302, the print engine receives from the RIP the last level that was reported. This is saved as a variable named "OLDLEVEL." In an alternative mode of operation, the printer may have already been turned on, but its cover had been opened. At a function block 310, the logic operational steps start when the cover is closed, and at a function block 312 a level is sent to the RIP having the designation "unknown."

At a decision block 320, the next logical operation determines whether or not the cartridge configuration has been read. If the answer is NO, the logical flow remains at this decision block 320 until the answer is YES. Once that occurs, the logic flow is directed to a function block 322 that sends the cartridge configuration information to the RIP. It will be understood that the processing system of the printer and the print engine is multitasking in nature, and the above "DO-loop" at decision block 320 does not literally lock up the operation of the printer while waiting to read a cartridge configuration, but is merely used as an indication as to the order of logical operating steps for this particular flow chart.

The logic flow now "waits" until a page is to be printed, which is determined at a decision block 330. Again, it will be understood that since the printer is a multitasking machine, the entire operation of the printer is not halted during this decision block's operation. Once there is a page to be printed, the logic flow is directed to a function block 322 that prints the page and sends the page "Toner Tally" to the RIP. The next logic step is at a decision block 334, which determines whether or not a toner level is available. In general, the actual level of the toner cartridge must fall from its full condition through at least one gradation level before making any toner tally or page remaining predictions. If the toner level is not available, the logic flow travels out the NO output back to decision block 330. If the toner level is available, the logic flow is directed to a decision block 336 that determines if the toner level that has been read is less than or equal to the "Toner Low" point. If the answer is YES, then function block 338 reports a "toner low" condition to the RIP.

If the answer at decision block 336 was NO, then the logic flow is directed to a decision block 340 that determines if the most recent toner level that has been read is either less than the previous level (i.e., the variable named "OLDLEVEL"), or is greater than the quantity {OLDLEVEL+2}. If the answer at decision block 340 is YES, the logic flow is directed to a function block 342 that sends to the RIP the level value that presently exists in the variable "OLDLEVEL." If the answer is NO at decision block 340, then the logic flow is directed to a function block 344 that sends the current level that was just read to the RIP. After that occurs, a is function block 346 sets the value of the variable OLDLEVEL equal to the most recent level that was read.

In the preferred embodiment, the print engine 36 interfaces with the toner cartridge 90 via data signal lines 92 and 94 (see FIG. 1). The output signal from the toner cartridge arriving on signal line 94 will be indicative as to the amount of toner remaining in the cartridge, as previously described. This information will preferably be proportional or nearly proportional (i.e., some type of linear relationship) to the amount of grams of toner remaining in the cartridge 90. The print engine calculates the amount of remaining toner and determines which "bucket" corresponds to the amount of remaining toner. The term "bucket" herein refers to which one of the gradations of remaining toner for this cartridge most nearly corresponds to the calculated amount of remaining toner in grams. To properly determine which bucket or gradation should correspond to the actual physical condition of the toner cartridge, the print engine must first know the configuration of this cartridge, as per the flow chart of FIGS. 4A and 4B. In one laser printing system manufactured by Lexmark International Incorporated, there are three (3) different toner cartridge sizes available for a single printer family. These three toner cartridge sizes correspond to a calculated number of pages that can be printed and in these three categories the cartridge sizes are 4K (corresponding to 4,000 pages), 7.5K (corresponding to 7,500 pages), and 17.6K (corresponding to 17,600 pages), all at 5% coverage.

Figure 7:
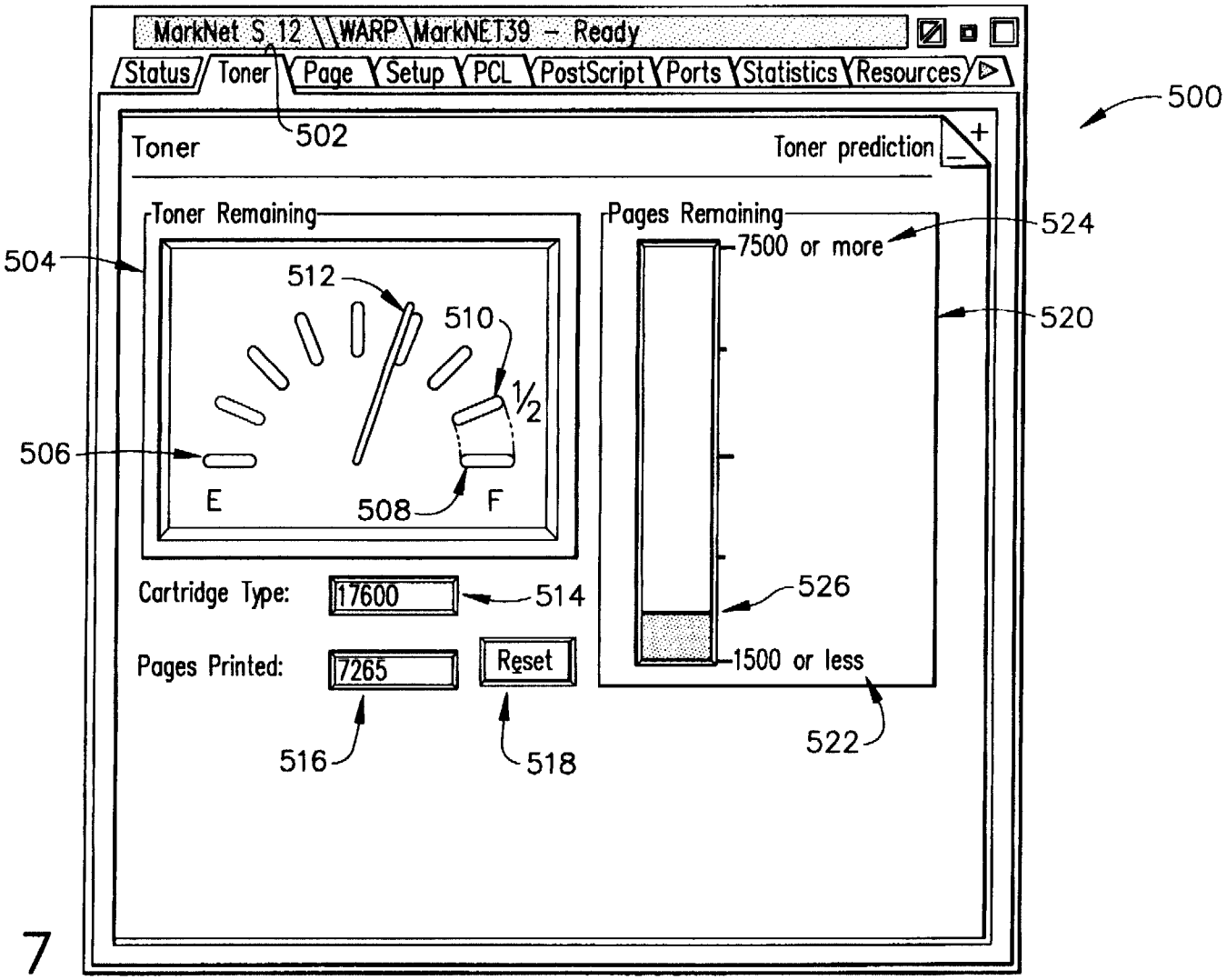
FIG. 7 is a view of a monitor screen at the host computer that displays the current toner level as well as the toner prediction information concerning the laser printer of FIG. 1.

In the illustrated embodiment of FIG. 7 depicting a monitor screen 500 that shows a display in graphical form of the toner remaining at reference numeral 504, the toner gradations or buckets are divided into one-eighth intervals, much like a gas gauge in an automobile. For example, in the 7.5K toner cartridge, each one-eighth interval represents approximately 1,000 pages that can be printed (at 5% coverage). In the illustrated "gas gauge" 504 on FIG. 7, the amount of toner above the "½" gradation mark at reference numeral 510 represents the half-empty point of a 17.6K toner cartridge. In both cartridges (i.e., the 7.5K and the 17.6K), the gradation levels run between the values of zero (0) and nine (9). When the toner cartridge is new, the gradation level reported by the print engine is equal to "9/8", which means that the needle 512 on FIG. 7 should be pointing at the "full" gradation mark 508, which is the ninth mark on the gauge.

For the 7.5K cartridge, the use of toner is nearly linear as the gauge needle 512 begins to fall on the display 504. For the 17.6K cartridge, however, the half-empty mark at reference numeral 510 is not reached until the cartridge is over half-empty, which occurs when there are approximately 7500 pages left to be printed (at 5% coverage) from this large toner cartridge. When that occurs, the gradation level reported by the print engine will be equal to "8/8". While at first glance it would seem that the print engine is reporting a completely full cartridge when the value is 8/8, what this actually represents is the eighth gradation level out of the range 0–9 possible gradation levels, and for the large 17.6K toner cartridge of the preferred embodiment, that represents the half-empty point.

For the smallest toner cartridge, having a 4K rating, the possible levels to be reported are in the range of 0–5. When the cartridge is new, the level reported will be "5/4", and each gradation level below that will represent approximately one-fourth of the capacity of this 4K cartridge. It can be seen that, once in the active range of toner depletion of each toner cartridge size, each gradation or bucket level represents approximately 1,000 pages remaining at 5% coverage to be printed by this cartridge.

When the cartridge is so full of toner that the level reported is "9/8" or "5/4", no prediction can be provided based upon actual printing history of this toner cartridge. The printer must wait until reaching a level which is two gradations away before making any predictions. That is not to say that a numeric value for pages remaining could not be displayed on the monitor screen shown in FIG. 7, and if pages remaining were to be displayed, the number of pages remaining while the toner cartridge is still nearly full could be based upon either a 5% page coverage estimate, or on the actual printing history of a previous cartridge. If this printer had already been used with a previous toner cartridge, then there would be some history of toner usage from which a prediction could potentially be based on, and that same predicted usage could be used even with a brand new cartridge, after which that calculation would be refined upon reaching the next lower gradation or bucket level of remaining toner. This is an optional feature which, depending upon the circumstances, of the usage of the printer, may not be desirable in an actual installation.

As the toner level continues to decrease, and more of the gradation levels are passed through and reported by the print engine, then the more accurate the actual printing history will be in determining the average toner usage per page as well as the predicted number of pages remaining in this toner cartridge. These calculations can be made either at the printer or at the host computer, as well as an additional calculation that could predict the number of days before the toner cartridge runs out of toner or ink. To calculate this last predicted value, the calculating device must know the real time that the toner level passed through at least two (2) gradations. If the printer contains a real time clock, then this calculation can be performed at the printer. On the other hand, since most printers do not contain a real time clock, it is preferred that the host computer make this calculation. For this to properly occur, the host computer must be running a computer program that is enabled to receive and accept messages from the printer, especially the particular messages in which the printer informs the host computer that a new gradation level has been reached. In the preferred embodiment, the host computer would be running a computer program named MARKVISION®, available from Lexmark International, Incorporated, whereas the printer is a Lexmark OPTRA®. In most personal computers running Windows®, manufactured by Microsoft Corporation, the MARKVISION® software can be running in the "background" or, in other words, running with a "minimized" icon window.

It will be understood that the number of toner levels or gradations that are supported by a printer and a given toner cartridge can be designed to work at any desired numeric values, such as 0–15, rather than the 0–9 or 0–5 discussed above. The available precision of the toner level measuring device would have a major impact in deciding how many gradations there ought to be so that each gradation transition (or toner level differential change) represents a significant physical quantity. It will also be understood that the larger toner cartridge not only could have its number of gradations increased, but could also add gradations to cover the upper half of the cartridge's volume. In the 17.6K toner cartridge related above, the toner level always is indicated as 9/8 until the toner level reaches the half-empty point. When that occurs, the gradation reported is 8/8. The preferred toner level reporting system could have been made to report higher levels of toner transition occurrences, although it should be noted that the lower amounts of toner remaining in a toner cartridge are usually more important to a user, because users generally want to be informed most accurately near the end of the toner cartridge's life, rather than near the beginning of that cartridge's life.

As related above, under certain circumstances the toner level is reported as "unknown" by the print engine to the RIP. When this occurs, this "unknown" status is passed to the host as an alert. Once the print engine has acquired a valid toner level reading, it will pass that information to the RIP, and the RIP will then alert the host computer about that change in status. Since the print engine knows precisely how many sheets of print media have been printed between the first two gradation level changes, the printer is fully capable of providing a quantity or numeric value of pages per gradation once two gradation levels actually occur.

When the print engine notifies the RIP of a level change to a new gradation transition, if this is not the first transition of a toner cartridge, the RIP will use the last stored "Pages Per Gradation" (i.e., "PPG") and average that number with the next prediction. The result of that averaging will be stored across Power on Reset sequences. If there are differences in the cartridge which cause a level transition to be declared earlier than ideal, the next transition occurrence will be larger than ideal, and thus the averaging of the two will increase the accuracy with which the predicted number of pages remaining can be made.

In general, the RIP ensures that the very first gradation of the cartridge is never used in the calculation of predicted pages per gradation. This first transition by itself is not valid for making this prediction, and this is true for all cartridge sizes. Under certain error conditions, the predicted pages per gradation is set equal to zero (0), and these error conditions include situations where the level reported by the print engine is greater than the previous level, or the level reported by the print engine is more than two (2) levels less than the previous reported level, or the level reported by the print engine is equal to the {number of levels in the cartridge−1}. In all other circumstances, upon a level transition the predicted pages per gradation is set equal to the quantity: {("Sheets Printed on Previous Level"+"Sheets Printed Since Last Transition")/2}. In addition, the value of the Sheets Printed on the Previous Level is set equal to the Sheets Printed Since the Last Transition, and this value is saved in the printer's RAM so that this value can be accessed by the host computer. The Sheets Printed Since Last Transition value is then zeroed out in the printer's EEPROM.

It is preferred that certain important information be stored in EEPROM at the RIP level in the printer. This includes the following functions or variables: (1) Sheets Printed Since Last Transition (SPLT), which is a count representing the number of pages printed since the last transition of the toner level (the RIP updates this count when the printer's page count is updated); (2) the Predicted Pages Per Gradation (PPG), which is calculated by the RIP when a toner level change is reported—if a host computer is attached running the MARKVISION utility program, this information will be written to the host and may include more accurate prediction information; (3) Last Reported Cartridge Capacity, which is information written by the RIP when the print engine reports that it has read the cartridge; (4) Last Reported Level, which is information written by the RIP when the print engine reports a toner level change; (5) Date of Last Transition (DLT), which is the date the last toner level transition occurred—the RIP zeros this value when a level change occurs, and MARKVISION, if connected, will write back the current date to the printer; (6) MARKVISION Age Indicator, which is information the printer's RIP supplies to the host computer's MARKVISION program—this information is used by the host computer to communicate identifier codes and age to other host computers to avoid having a "less experienced" host corrupt the Predicted Page Count; (7) Toner Cartridge Sheet Counter, which is a true page counter that is written by the printer's RIP on completion of every print job—this value should be reset whenever a cartridge has been changed, and it should be read by a host computer running MARKVISION to show an actual page count for a cartridge; (8) Date of Previous Transition (DPT), which is not reset upon a new transition of the toner level—this information is needed in case a host running MARKVISION was not running when a transition occurred, so that the predicted days left can be estimated immediately by a new instance of a host running MARKVISION, and when a valid transition occurs, the printer's RIP moves the "Date of Last Transition" into this memory location; and (9) Sheets Printed on Previous Level (SPPL), which records the number of sheets printed since the previous level transition.

Figure 6A:
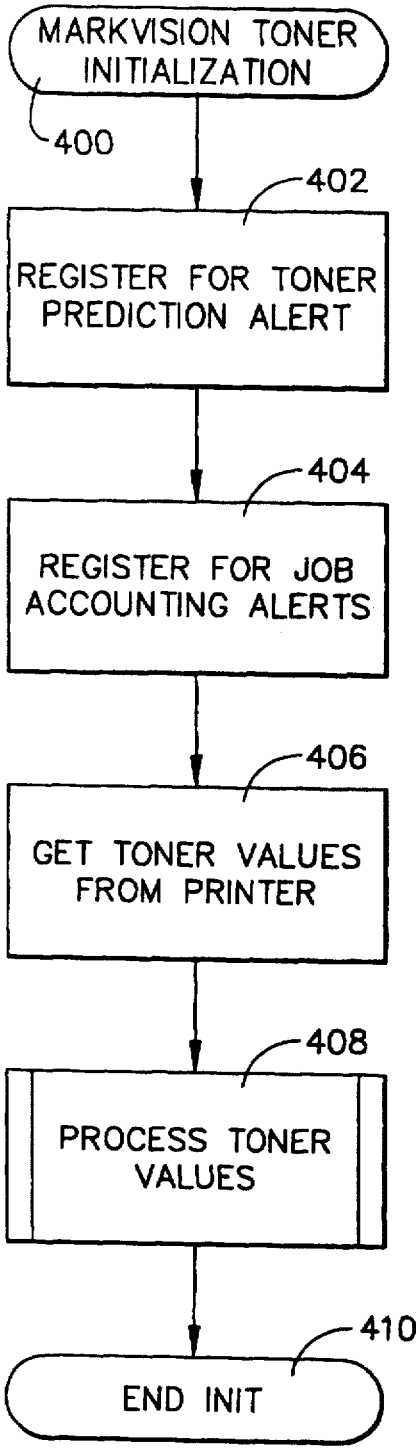
FIGS. 6A–6C are flow charts depicting the logical steps taken by a host computer that is in communication with the laser printer of FIG. 1, and which receive data from that printer so that the toner level and toner prediction information can be displayed on a monitor at a host computer.

While many of the important functions of the present invention occur at the printer, it can be seen from the above information that a host computer running a printer utility program such as MARKVISION, manufactured by Lexmark International, Incorporated, is also very important as far as transferring information to a human user of a printing network or directly connected printer. On FIG. 6A, a flow chart is depicted showing the initialization routine used in a MARKVISION computer program concerning the Toner Prediction feature. Starting at a function block 400, the initialization begins by directing the logic flow to a function block 402, where the host computer will register for "Toner Prediction Alerts." After that has occurred, a function block 404 will register for "Job Accounting Alerts."

At a function block 406, the host computer now receives the toner value from the printer, and at a function block 408, the toner values are processed. After that has occurred, the end of the initialization procedure is reached at a function block 410. Function block 408 actually represents several important logical operations, which are described in more detail in FIG. 6C, and discussed hereinbelow.

Figure 6B:
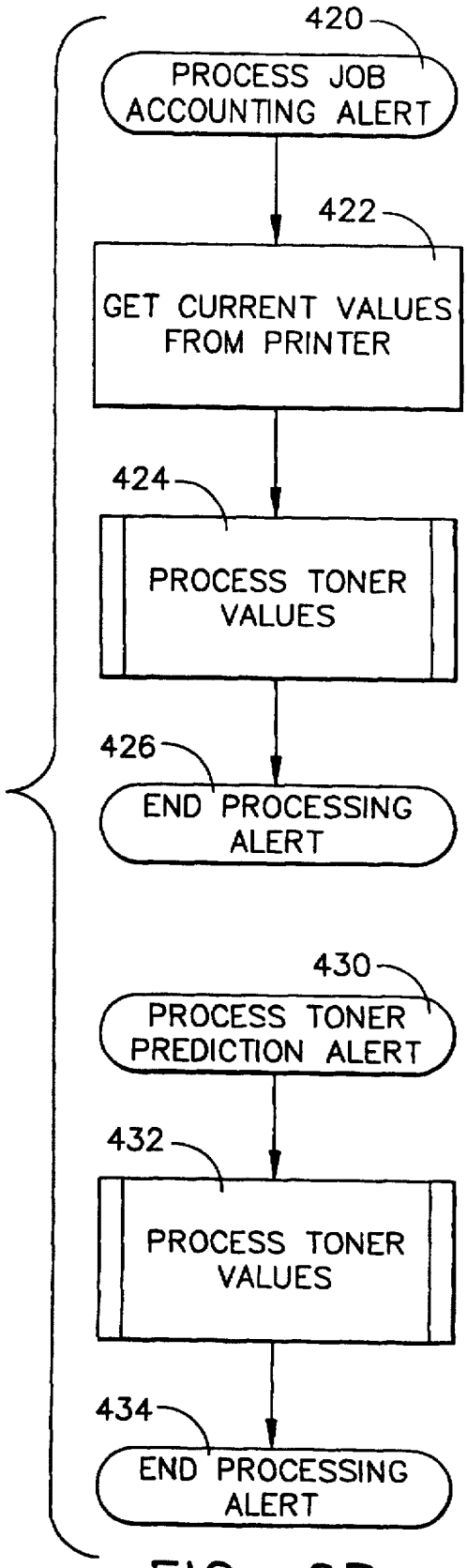

FIG. 6B depicts the flow charts for processing Job Accounting Alerts and Toner Prediction Alerts. Starting at a function block 420, a Job Accounting Alert begins by receiving the current values from the appropriate printer at a function block 422. At a function block 424 the toner values are processed, and this function block is actually a series of logical operations discussed more fully in connection with FIG. 6C. The end of the processing of the Job Accounting Alert occurs at a function block 426.

At a function block 430, the beginning of the processing for a Toner Prediction Alert directs the logic flow to a function block 432 that processes the toner value. These operational steps are described in more detail in FIG. 6C. The end of the processing for a Toner Prediction Alert occurs at a function block 434.

Figure 6C:
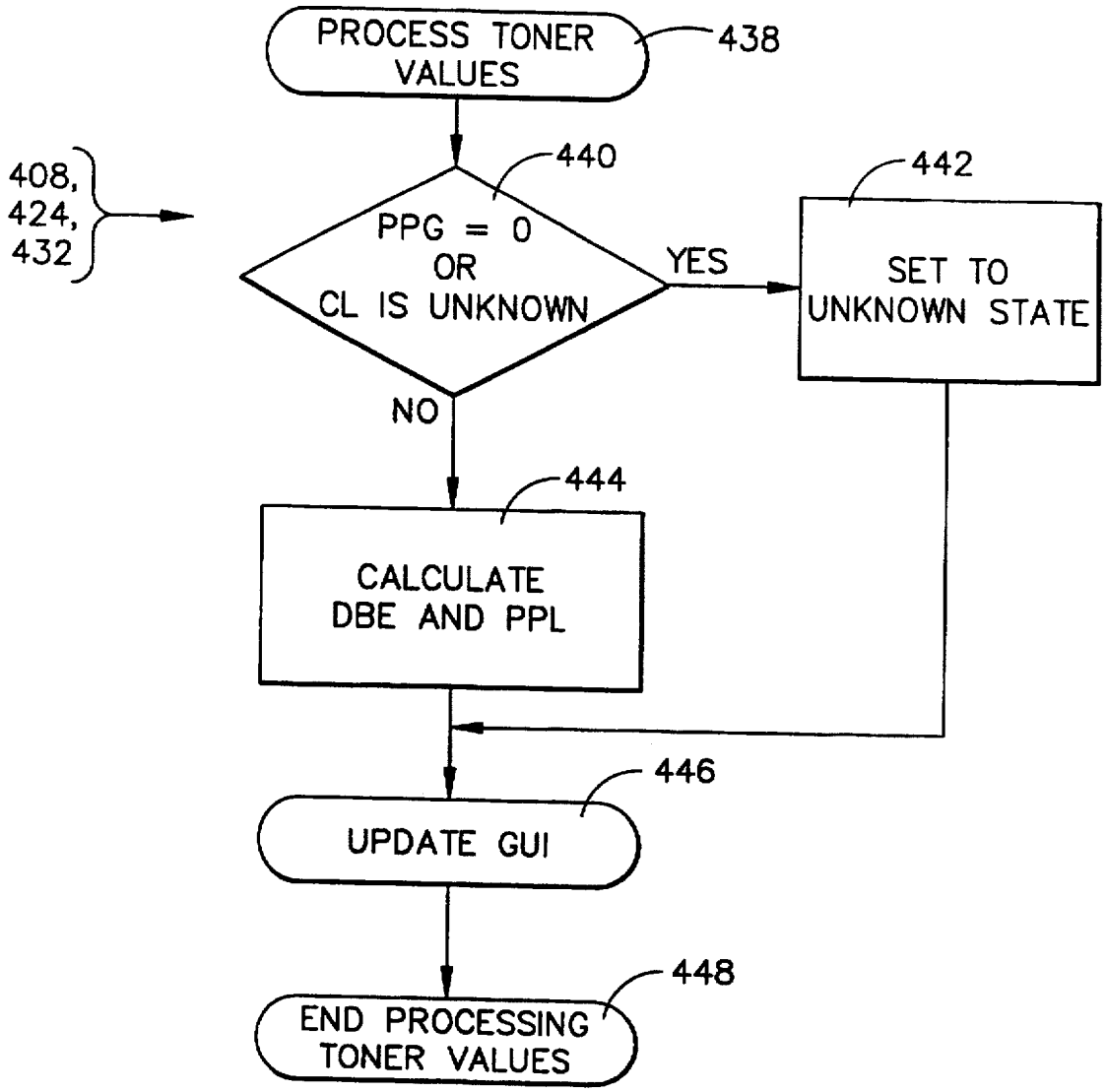

On FIG. 6C, the detailed steps for processing toner values is depicted, starting at an initial function block 438. A decision block 440 determines whether or not the Predicted Pages Per Gradation (PPG) has been set to zero (0), or if the Current Level (CL) is unknown. If the answer is YES, a function block 442 will set the Current Level equal to "unknown" status. If the answer is NO, a function block 444 will calculate the "Days Before Empty" (DBE) and "Predicted Pages Left (PPL) variables. The graphic user interface (GUI) is now updated by a function block 446, so that the human user at the host computer may see the most recent data. After that has occurred, this subroutine comes to an end at a function block 448.

Figure 6D:
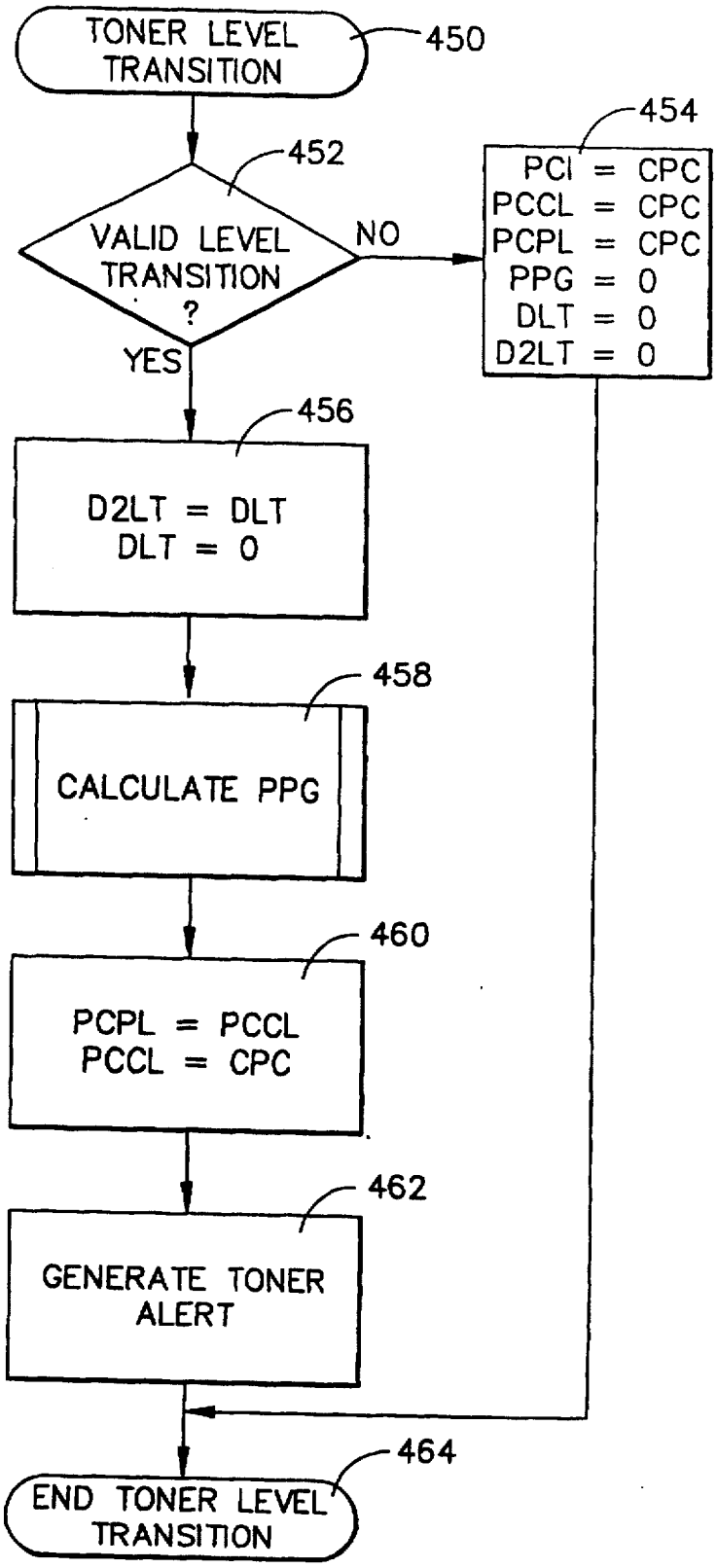
FIGS. 6D–6E are flow charts depicting the logical steps performed by the rasterizer portion of the laser printer of FIG. 1, when the remaining toner quantity changes by a discrete level.

FIG. 6D depicts a flow chart of the logical operational steps performed by the printer's RIP upon the transition of a toner level at the printer. Beginning at a function block 450, a new toner level transition has just occurred. At a decision block 452, it is determined whether or not the level transition was for a valid new level. If the answer is YES, the logical processing continues under normal circumstances. If the answer is NO, then a function block 454 sets many of the variables in the system to certain predetermined values. For example, the "Page Count when Cartridge Installed" variable (PCI) is set to the value of the "Current Page Count" (CPC). In addition, two (2) other variables are set to the Current Page Count, and these variables are the "Page Count at Start of Current Level" (PCCL) and the "Page Count at Start of Previous Level" (PCPL).

Function Block 454 also sets several variables to zero (0), including the variables "Predicted Pages per Gradation" (PPG), the "Date of Last Transition" (DLT), and the "Date of Second to Last Transition" (D2LT).

If the result at decision block 454 was YES, a function block 456 sets the value of D2LT equal to the value of DLT (Date of Last Transition). After that occurs, function block 456 zeros the value of DLT. A function block 458 now calculates an updated value of Predicted Pages per Gradation (PPG), which is actually a series of logical operations that are described in greater detail on FIG. 6E.

A function block 460 now sets the variable PCLP (i.e., Page Count at Start of Previous Level) equal to the variable PCCL (i.e., Page Count at Start of Current Level), and after that sets the value of PCCL equal to the variable CPC (i.e., the Current Page Count). A function block 462 now generates a Toner Alert, which tells the host computer to change its "Gas Gauge" level accordingly. A function block 464 now is reached, which is the end of the Toner Level Transition Subroutine.

Figure 6E:
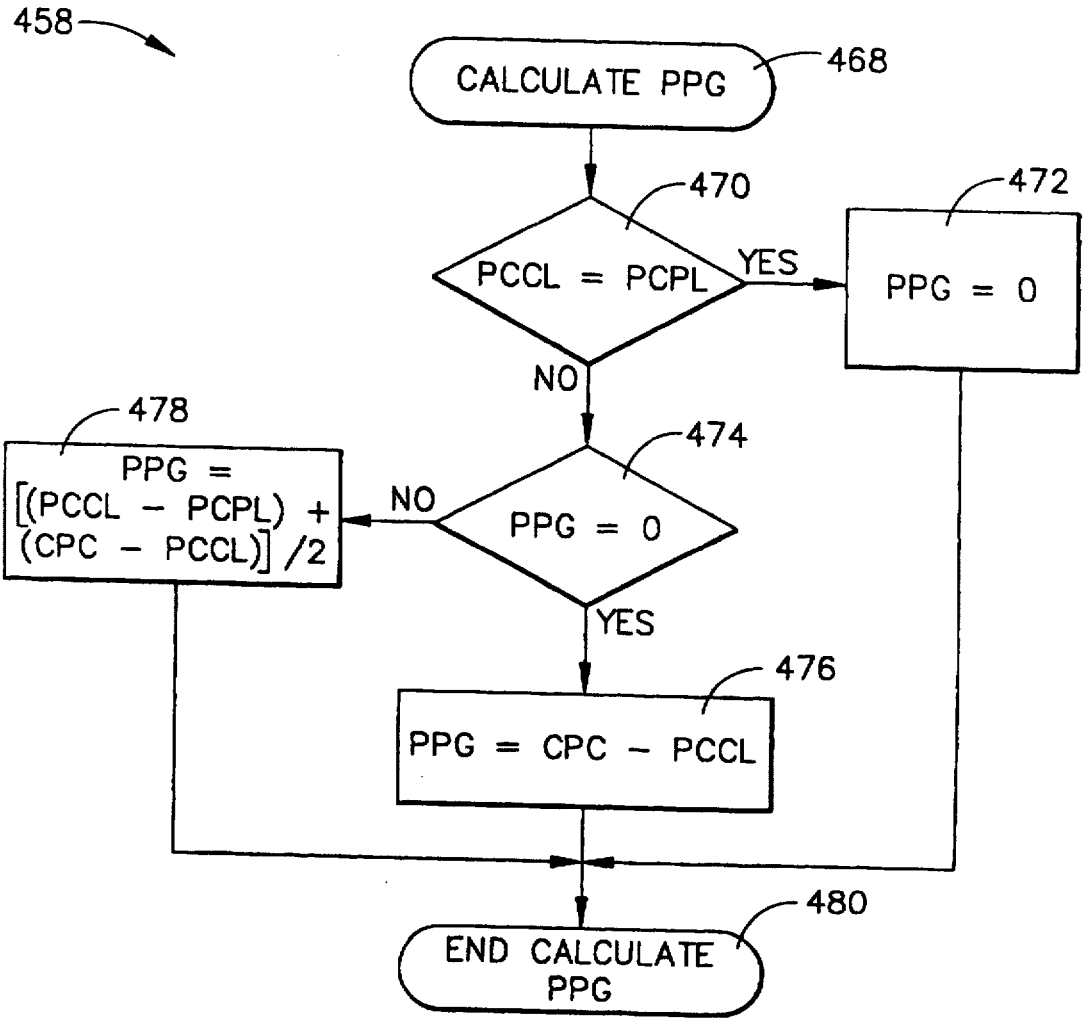

FIG. 6E shows the details of the logical steps to calculate the Predicted Pages per Gradation (PPG), starting at a function block 468. At a decision block 470, the Page Count at Start of Current Level (PCCL) is tested to see if it is equal to the Page Count at Start of Previous Level (PCPL). If the answer is YES, the logic flow is directed to a function block 472 that sets the Predicted Pages per Gradation (PPG) variable to zero (0).

If the result at decision block 470 was NO, then a decision block 474 tests to see if the Predicted Pages per Gradation (PPG) variable was already set to zero (0). If the answer is YES, then a function block 476 sets the value of the Predicted Pages per Gradation (PPG) equal to the value {CPC−PCCL}. If the answer at decision block 474 is NO, then a function block 478 sets the value for Predicted Pages per Gradation (PPG) equal to the quantity: {[(PCCL−PCPL)+(CPC−PCCL)]/2}. After these calculations have occurred, the end of the subroutine to calculate the PPG is reached at a function block 480.

As can be seen from the above related information concerning the flow charts showing the operational steps of a host computer, it can be seen that the host computer in the present invention accepts and tracks toner gradation changes from the printer by "arming" for Toner Alerts. The host will also accept and track the total pages printed for a particular cartridge, will record and save the date of each toner gradation change at the printer, will accept and track the amount of toner used per job (if the "Job Accounting" Alerts are enabled), and save that information in a job statistics file for later processing by the user. The host computer will also calculate the estimated number of pages remaining in the currently installed toner cartridge, and will communicate with other host computers running MARKVISION, via the printer's NVRAM, so that the predicted variables in a "lesser experienced" MARKVISION running at one host computer reflects the information contained by the most experienced host computer residing on the same network that is running MARKVISION. This information is to be displayed in a clear and concise manner to a user at the host computer on the user's display monitor.

An exemplary display is provided on FIG. 7 which depicts a monitor screen, generally indicated by the reference numeral 500, that shows the important information concerning toner usage of a printer. Monitor screen 500 shows a "gas gauge" indicating the amount of toner remaining in the cartridge, and a bar graph indicating the estimated sheets or pages remaining, based upon the actual history of the printer's usage of toner or ink. These estimates are updated on a job-by-job basis, and are recalibrated when the print engine detects a transition from gradation "n" to gradation "n-1". When that occurs, the host computer will use the Pages Per Gradation (PPG) value calculated by the printer, multiply this number by the remaining gradations, and will add the number of pages left after the last level that can be measured by the printer's level measuring device, to arrive at the Predicted Pages Left (PPL) in the cartridge.

The host computer must be able to handle a level change that arrives during a print job, and to be able to show that new level immediately. This occurs via a "Toner Level Alert." The "gas gauge" is generally depicted by the reference numeral 504, and the bar graph is generally depicted by the reference numeral 520. These displays are brought up when the "Toner" tab is selected, as shown at reference numeral 502.

On the toner gas gauge 504, the gradation markings range from the "Empty" mark 506, to the "Full" mark 508. The current level is indicated by the needle 512, and the "½" level is indicated at numeral 510. On FIG. 7, the toner gas gauge 504 is displayed for a 17.6K cartridge, which, as described above, provides no information between the full mark 508 and the "½" mark 120, as to any more precise page remaining or toner remaining status.

The type of cartridge is depicted in a small display at the reference numeral 514, which is equal to the size of the cartridge, in this case 17,600 pages (at 5% coverage). Another value is displayed at reference numeral 516, which is the actual number of pages printed from this toner cartridge up to this point. A "Reset" button is provided at reference numeral 518, which is to be manually operated on (by "clicking" a mouse or cursor) when a new toner cartridge is installed in the printer of interest.

On the bar graph 520, the pages remaining are shown as a predicted quantity, and the minimum and maximum values for the large 17.6K cartridge are shown as "1500 or Less," at reference numeral 522, and "7500 or More," at reference numeral 524. Depending upon the actual device that measures the toner level in a cartridge, there will undoubtedly be a minimum amount of toner that cannot be measured very easily, so the displaying of a number of pages remaining as "1500 or Less" on the monitor screen 500 reflects the fact that it is difficult to measure every last gram of toner available in a cartridge. The maximum value of "7500 or more" at numeral 524 merely reflects the preferred embodiment in which the one-half point of the large printer cartridge is reached before the more accurate pages remaining predictions become recalibrated upon level changes. On bar graph 520 the Actual Pages Remaining prediction is shown at the reference numeral 526, which displays a numeric value of approximately 2200 pages remaining. As can be seen from the numeric values presented at the reference numerals 514 and 516, the print history of the particular printer depicted on display 500 indicates a rather heavy usage of toner per page. Otherwise, if the 5% coverage were accurate, then there should be over 10,000 pages remaining if only 7265 pages had already been printed on a cartridge having a total capacity of 17,600 pages.

There are times when the toner level changes in a direction that is unexpected, such as times when the toner cartridge is temporarily removed from the printer and shaken to somewhat stir up its contents. When that occurs, the measured toner level may actually increase by a gradation level, which could temporarily confuse the MARKVISION utility program running at a host computer. If this situation occurs, the display 500 temporarily removes the needle 512 on the gas gauge 504, to inform the user that the prediction cannot be performed because a level change from the print engine indicates some uncertainty, such as where the cartridge may have been changed. In this circumstance, the RIP in the printer will zero out the Predicted Pages per Gradation (PPG) variable when the print engine sends a level change which either increases, or decreases by more than one level from the previously sent value. This unknown state will exist for some time after the toner cartridge has been shaken, approximately for the next twenty (20) pages being printed by this printer. After the twenty pages have been printed, if the level increased due to the toner being stirred or shaken, then the level should settle down and read as its former actual level. On the other hand, if a new cartridge has been installed, then the level will remain at its maximum, such as at the 9/8 gradation level.

The details of some of the predicted values are now provided, starting with the calculation of Pages Per Gradation (PPG). When the engine reports a level change to the RIP, the RIP will attempt to calculate a Predicted Pages per Gradation. If the newly reported toner level was one gradation lower than the last reported level, then the new Pages Per Gradation (PPG) is simply the average of the Sheets Printed since Last Transition (SPLT) and the number of Sheets Printed during the Previous level (SPPL). If the Sheets Printed during the Previous Level is not known, the Sheets Printed since Last Transition is used. If, however, the engine reports a level change in which the level goes up, or the level goes down by more than 1 gradation, the PPG is set to 0. A generic computer program to execute these calculations follows:

```
If (New Level = Old Level − 1) Then
    If PPG != 0 Then
        NewPPG = {(SPLT + SPPL)/2}
    Else
        NewPPG = SPLT
    End If
Else
    NewPPG = 0
End If
The definitions for the above variables are:
        PPG = Pages Per Gradation
        SPLT = Sheets Printed since Last Transition
        SPPL = Sheets Printed in Previous Level
```

Another calculation performed is the "Scaled Pages After Last Level." Since the number of sheets left in the cartridge after the last level has been detected by the engine can vary depending upon the toner coverage on a page, the host must create the value of "SPALL" using scaling of the PPG values. The calculation for the determination of the Scaled Pages In Last Level (SPALL) is depicted below by a generic computer program:

```
If PPG > PPG_light Then
    SPALL = PALL_light
Else
    If PPG < PPG_dark Then
    SPALL = PALL_dark
    Else
        SPALL = {PALL_light − [(PPG_light − PPG) * (PAL_light −
PALL_dark)]/
                                (PPG_light - PPG_dark)]}
    End If
End If
```

The definitions for the above variables are:

SPALL=Scaled Pages After Last Level

PALL_light=Pages After Last Level for a low coverage page

PALL_dark=Pages After Last Level for a high coverage page

PPG_light=Average Pages Per Gradation for a low coverage page

PPG_dark=Average Pages Per Gradation for a high coverage page

PPG=Current Pages Per Gradation value

Another important operation is the calculation of Predicted Pages Left (PPL). The calculation of Predicted Pages Left is the sum of three main components. The first component is a simple product of the Pages Per Gradation (PPG) and the Current Level (CL). From this value is subtracted the number of Sheets which have been Printed since the Last Transition (SPLT). Finally, since the cartridge is not completely empty when it reaches the level zero point, an adder is included to estimate extra sheets which weren't included in the previous two components. This component, termed Scaled Pages After Last Level (SPALL) is calculated using the above equations, and the entire calculation is presented below:

$$PPL=\{(PPG * CL)-SPLT+SPALL\}$$

The definitions for the above variables are:

PPL=Predicted Pages Left

PPG=Pages Per Gradation

CL=Current Level (reported by the engine)

SPLT=Sheets Printed since Last Transition

SPALL=Scaled Pages After Last Level

This prediction provides an estimate of the number of sheets which can be printed before the cartridge goes empty.

Another important operation is the calculation of Days Before Empty (DBE), which uses the past usage history of the printer and simply determines how long it took the printer to print the number of pages which were predicted out of the above prediction calculations. Based on how long it took to print these number of pages, the system predicts when the toner will be low.

For similar reasons to storing the page number of the last level change, the Date of the Last Transition can also be stored. In this fashion, if a printer has been turned off, or the printer hasn't been tracked by MARKVISION due to interruptions in it's connection, there is enough information to yield a "Time Until Empty" calculation.

$$DBE = PPL * \frac{\left(\frac{DLT - DPT}{SPPL}\right) + \left(\frac{\text{Current Date} - DLT}{SPLT}\right)}{2}$$

The definitions for the above variables are:

DBE=Days Before Empty

PPL=Predicted Pages Left

DLT=Date of Last Transition

DPT=Date of Previous Transition

SPPL=Sheets Printed in Previous Level

SPLT=Sheets Printed in Last Transition

DLT=Date of Last Transition

This equation states that Days Before Empty is equal to the average of the "Days Per Sheet" for the last level and the Days Per Sheet for the previous level, times the number of predicted pages left.

The following tables show a detailed listing of the information that passes between the printer and the host computer running MARKVISION in connection with the toner prediction system information of the present invention.

TABLE 1

NPA specification additions

Supply Information
Host Command

Command: Lexmark Extension
Subcommand: Supply Information

| Byte | Value-Hex | Description | Notes |
|---|---|---|---|
| 1 | A5 | Start of Packet Byte | Packet Header |
| 2 | 00 04 | Length in Bytes (Does not include these 2 bytes nor the SOP byte) | |
| 1 | Unsigned Byte | Flag | |
| 1 | E0 | Command:Lexmark Extension | |
| 1 | 07 | Subcommand: Supply Information | Data Field |
| 1 | Unsigned Byte | Function: Supply Information Type | |
| | 0 × 01 | Ink Jet: Ink Status | |
| | 0 × 02 | Toner Prediction | |
| 1 | Unsigned Byte | Supply ID (0 × 0 = all appropriate supplies) | |

Printer Response

Command: Lexmark Extension
Subcommand: Supply Information
Function: Inkjet: Ink Status

| Byte | Value-Hex | Description | Notes |
|---|---|---|---|
| 1 | A5 | Start of Packet Byte | Packet Header |
| 2 | Unsigned Word | Length in Bytes (Does not include these 2 bytes nor the SOP byte) | |
| 1 | Unsigned Byte | Flag | |
| 1 | E0 | Command:Lexmark Extension | |
| 1 | 07 | Subcommand: Supply Information | Data Field |
| 1 | 0 × 02 | Function: Ink Jet: Ink Status | |
| 1 | Unsigned Byte | Number of Supplies responding | |
| 1 | 0 × 06 | Length of Ink Status record | |
| 1 | Unsigned Byte | Location of Supply | |
| 1 | Unsigned Byte | Supply ID | |
| 4 | Unsigned Dbl Word | Dot Count | |

Printer Response

Command: Lexmark Extension
Subcommand: Supply Information
Function: Toner Prediction Status

| Byte | Value-Hex | Description | Notes |
|---|---|---|---|
| 1 | A5 | Start of Packet Byte | Packet Header |
| 2 | Unsigned Word | Length in Bytes (Does not include these 2 bytes nor the SOP byte) | |
| 1 | Unsigned Byte | Flag | |
| 1 | E0 | Command:Lexmark Extension | |
| 1 | 07 | Subcommand: Supply Information | Data Field |
| 1 | 0 × 02 | Function: Toner Prediction | |
| 1 | Unsigned Byte | Length of printer's serial number, not including this byte | |
| n | ASCII | Printer's Serial Number | |
| 1 | Unsigned Byte | Number of Supplies responding | |
| 1 | Unsigned Byte | Length of Toner prediction record | |
| 1 | Unsigned Byte | Location of Supply | |
| 1 | Unsigned Byte | Toner Prediction type | |
| | 01 | Optra S toner prediction | |
| 1 | Unsigned Byte | Supply ID as defined by the RDS Request Supply Status command | |

TABLE 1-continued

| NPA specification additions | | |
|---|---|---|
| 4 | Unsigned Dbl Word | Current Page Count |
| 4 | Unsigned Dbl Word | Last Transition Page Count |
| 1 | Unsigned Byte | Transition Granularity Level |
| 1 | Unsigned Byte | Current Transition Level |
| 1 | Unsigned Byte | Toner Type |
| | 00 | Non-MICR |
| | 01 | MICR |
| 1 | Unsigned byte | Length of toner part number |
| n | ASCII | Toner part number |
| 1 | Unsigned Byte | Toner Capacity (only lower 4 bits valid) |
| 1 | Unsigned Byte | State of Toner Transition Level |
| | | Unknown(not enough time to read) |
| | | Known |
| 2 | Unsigned Word | MV's current prediction |
| 1 | Unsigned Byte | Last Gradation Interval Percent Coverage |
| 1 | Unsigned Byte | Current interval Percent Coverage |

Toner Prediction Alert
Printer Alert

Command: Lexmark Alert
Subcommand: Toner Prediction Alert

| Byte | Value-Hex | Description | Notes |
|---|---|---|---|
| 1 | A5 | Start of Packet Byte | Packet Header |
| 2 | Unsigned Word | Length in Bytes (Does not include these 2 bytes nor the SOP byte) | |
| 1 | Unsigned Byte | Flag | |
| 1 | F0 | Command:Lexmark Alert | |
| 1 | 04 | Subcommand: Lexmark Extension Alert II | Data Field |
| 1 | 0 × 01 | Toner Prediction Alert | |
| 1 | Unsigned Byte | Length of printer's serial number, not including this byte | |
| n | ASCII | Printer's Serial Number | |
| 1 | Unsigned Byte | Toner Prediction type | |
| | 01 | Optra S toner prediction | |
| 1 | Unsigned Byte | Supply ID as defined by the RDS Request Supply Status command | |
| 4 | Unsigned Dbl Word | Current Page Count | |
| 4 | Unsigned Dbl Word | Transition Page Count | |
| 1 | Unsigned Byte | Transition Granularity Level | |
| 1 | Unsigned Byte | New Transition Level | |
| 1 | Unsigned Byte | Toner Type | |
| | 00 | Non-MICR | |
| | 01 | MICR | |
| 1 | Unsigned byte | Length of toner part number | |
| n | ASCII | Toner part number | |
| 1 | Unsigned Byte | Toner Capacity (only 4 bits valid) | |
| 1 | Unsigned Byte | State of Toner Transition Level (only 4 bits valid) | |
| | | Unknown(not enough time to read) (MSB of byte set) | |
| | | Known (MSB of byte clear-4 bits in lower nibble) | |
| 2 | Unsigned Word | MV's current prediction | |
| 1 | Unsigned Byte | Last gradation interval percent coverage | |
| 1 | Unsigned Byte | Current interval percent coverage | |

Note:
This alert is only returned in printer specific extension revision level 9 or greater and on printers that can support toner prediction functions.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A printing apparatus, comprising: a cartridge that contains a toner material that is used to create printing indicia on a print media; an interface circuit that measures the physical quantity of said toner within said cartridge; a memory circuit that stores information, and a processing circuit; wherein said interface circuit is configured to transmit a toner level signal to said processing circuit, said toner level signal being related to the physical toner level remaining in said cartridge; and said processing circuit is configured to determine a toner usage per printed page statistic based upon the previous number of pages that have been printed by said printing apparatus with respect to the physical toner level of said cartridge; said toner usage per printed page statistic being used by said processing circuit to predict the number of pages that can be printed using the physical quantity of toner remaining within said cartridge.

2. The printing apparatus as recited in claim 1, further comprising said processing circuit being configured to use real time from at least one time in the past to determine a toner usage per day statistic based upon the previous number of pages that have been printed by said printing apparatus with respect to the physical toner level of said cartridge and the real time at which at least one previous measurement of said physical toner level of the cartridge was taken; said toner usage per day statistic being used by said processing circuit to predict the number of days remaining before said cartridge effectively runs out of toner material.

3. The printing apparatus as recited in claim 2, wherein said real time is obtained from a host computer that is in communication with said printing apparatus, and includes both time and date.

4. The printing apparatus as recited in claim 2, further comprising said interface circuit being configured to report said toner level signal to said processing circuit in gradation levels, wherein upon the occurrence of a transition from one gradation level to another gradation level, the real time and the "new" gradation level are stored in said memory circuit; and a recalibrated toner usage per printed page statistic is determined, and a recalibrated toner usage per day statistic is determined, and both said statistics are stored in said memory circuit.

5. The printing apparatus as recited in claim 4, wherein said real time is obtained from a host computer that is in communication with said printing apparatus, and includes both time and date.

6. The printing apparatus as recited in claim 1, wherein said printing apparatus comprises a laser printer.

7. The printing apparatus as recited in claim 1, wherein said printing apparatus comprises an ink-jet printer, and said toner material comprises ink.

8. The printing apparatus as recited in claim 1, further comprising a host computer that communicates with said printing apparatus via a first communications port at said printing apparatus, a second communications port at said host computer, and a communications link therebetween; and a visual monitor connected to said host computer, wherein said monitor is configured to display: a "gas gauge" of remaining toner within said cartridge, a numeric quantity relating to the capacity of said cartridge when new, and a numeric quantity relating to the number of pages that have been printed using that particular cartridge; and said monitor is further configured to display a "bar chart" of "predicted pages remaining" to be printed by the quantity of toner remaining in said cartridge, based upon the previous history of toner usage with respect to an actual number of pages that have been printed by said printing apparatus using said cartridge.

9. The printing apparatus as recited in claim 8, wherein said monitor is yet further configured to display a numeric quantity relating to a predicted number of days remaining before said cartridge effectively runs out of toner material.

10. The printing apparatus as recited in claim 8, wherein, upon power-on initialization of said host computer, said printing apparatus communicates a message that informs said host computer of said remaining toner within said cartridge, said number of pages that have been printed, and said predicted pages remaining.

11. The printing apparatus as recited in claim 8, further comprising a second host computer that communicates with said printing apparatus via a third communications port as said second host computer, and a second visual monitor connected to said second host computer, wherein said second host computer initially contains no prior history of said printing apparatus and the other host computer does contain a prior history of said printing apparatus, and said second host computer is configured to "immediately" learn from said other host computer said remaining toner within said cartridge, said number of pages that have been printed, and said predicted pages remaining, all relating to said printing apparatus.

12. In a printing system having a cartridge that contains a toner material that is used to create printing indicia on a print media, an interface circuit that measures the physical quantity of said toner within said cartridge, a memory circuit that stores information, and a processing circuit, a method of determining toner usage statistics, said method comprising the steps of:

(a) measuring the actual toner level remaining in said cartridge, and transmitting a corresponding toner level signal from said interface circuit to said processing circuit, (b) determining a toner usage per printed page statistic based upon a previous number of pages that have been printed from said cartridge with respect to the physical toner level of said cartridge; and (c) predicting a statistic of the number of pages that can be printed using the physical quantity of toner remaining within said cartridge, based upon said toner usage per printed page statistic and the remaining toner of said cartridge.

13. The method as recited in claim 10, further comprising the step of:

(d) predicting a statistic of the number of days remaining before said cartridge effectively runs out of toner material, based upon a toner usage per day statistic that is related to the physical toner level of said cartridge and the real time at which at least one measurement of said physical toner level of the cartridge previously was taken.

14. The method as recited in claim 13, wherein said physical toner level of the cartridge is reported to said processing circuit in gradation levels, and upon the occurrence of a transition from one gradation level to another gradation level, storing the real time and the "new" gradation level in said memory circuit; and further comprising the steps of: recalibrating the toner usage per printed page statistic, recalibrating the toner usage per day statistic, and storing both said statistics in said memory circuit.

15. The method as recited in claim 13, further comprising the step of providing a host computer that transmits the real time to said printing system via a communications link, wherein said real time includes both time and date.

16. The method as recited in claim 15, further comprising the step of providing a display monitor at said host computer, wherein said monitor displays a "gas gauge" of remaining toner within said cartridge, a numeric quantity relating to the capacity of said cartridge when new, and a numeric quantity relating to the number of pages that have been printed using that particular cartridge; and displays a "bar chart" of "predicted pages remaining" to be printed by the quantity of toner remaining in said cartridge, based upon the previous history of toner usage with respect to an actual number of pages that have been printed by said printing system using said cartridge.

17. The method as recited in claim 16, further comprising the step of: upon power-on initialization of said host computer, said printing system communicating a message that informs said host computer of said remaining toner within said cartridge, said number of pages that have been printed, and said predicted pages remaining.

18. The method as recited in claim 16, further comprising the step of: said printing system communicating a message to a second host computer containing information derived from the other host computer, wherein said second host computer initially contains no prior history of said printing system and said other host computer does contain a prior history of said printing system, thereby "immediately" informing said second host computer of said remaining toner within said cartridge, said number of pages that have been printed, and said predicted pages remaining, all relating to said printing system.

19. The method as recited in claim 13, further comprising the step of displaying a numeric quantity relating to a predicted number of days remaining before said cartridge effectively runs out of toner material.

* * * * *